US006580343B2

(12) United States Patent
Saitoh et al.

(10) Patent No.: US 6,580,343 B2
(45) Date of Patent: Jun. 17, 2003

(54) DIELECTRIC WAVEGUIDE WITH PAIRS OF DIELECTRIC STRIPS CONNECTED IN AN OFF-SET MANNER

(75) Inventors: Atsushi Saitoh, Muko (JP); Toru Tanizaki, Kyoto (JP); Hiroshi Nishida, Kawanishi (JP); Ikuo Takakuwa, Suita (JP); Yoshinori Taguchi, Kuse-gun (JP); Nobuhiro Kondo, Hirakata (JP); Taiyo Nishiyama, Otsu (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/971,794

(22) Filed: Oct. 5, 2001

(65) Prior Publication Data

US 2002/0021196 A1 Feb. 21, 2002

Related U.S. Application Data

(62) Division of application No. 09/114,738, filed on Jul. 13, 1998, now Pat. No. 6,307,451.

(30) Foreign Application Priority Data

Jul. 11, 1997 (JP) ..... 9-186358
Feb. 18, 1998 (JP) ..... 10-36204

(51) Int. Cl.[7] ..... H01P 3/16
(52) U.S. Cl. ..... 333/239; 333/254

(58) Field of Search ..... 333/239, 248, 333/254

(56) References Cited

U.S. PATENT DOCUMENTS 3,577,105 A * 5/1971 Jones, Jr. ..... 333/254 X
5,917,232 A * 6/1999 Tanizaki et al. ..... 333/254 X

FOREIGN PATENT DOCUMENTS

JP 59144901 9/1984
JP 8070205 12/1996

OTHER PUBLICATIONS

Japanese Rejection Notice w/ Translation; Issue No.: 505933; Dated: Sep. 25, 2001.

* cited by examiner

*Primary Examiner*—Benny Lee
(74) *Attorney, Agent, or Firm*—Dickstein, Shapiro, Morin & Oshinsky, LLP.

(57) ABSTRACT

A dielectric waveguide designed to avoid the influence of reflection of electromagnetic waves at connected portions of dielectric strips and to have an improved characteristic. The distance L between connection planes between pairs of dielectric strips adjacent in the direction of propagation of an electromagnetic wave is set to an odd number multiple of ¼ of the guide wavelength. Reflected waves are thereby superposed in phase opposition to each other to cancel out. In this manner, propagation of a reflected signal to ports is limited.

16 Claims, 23 Drawing Sheets

FIG. 11
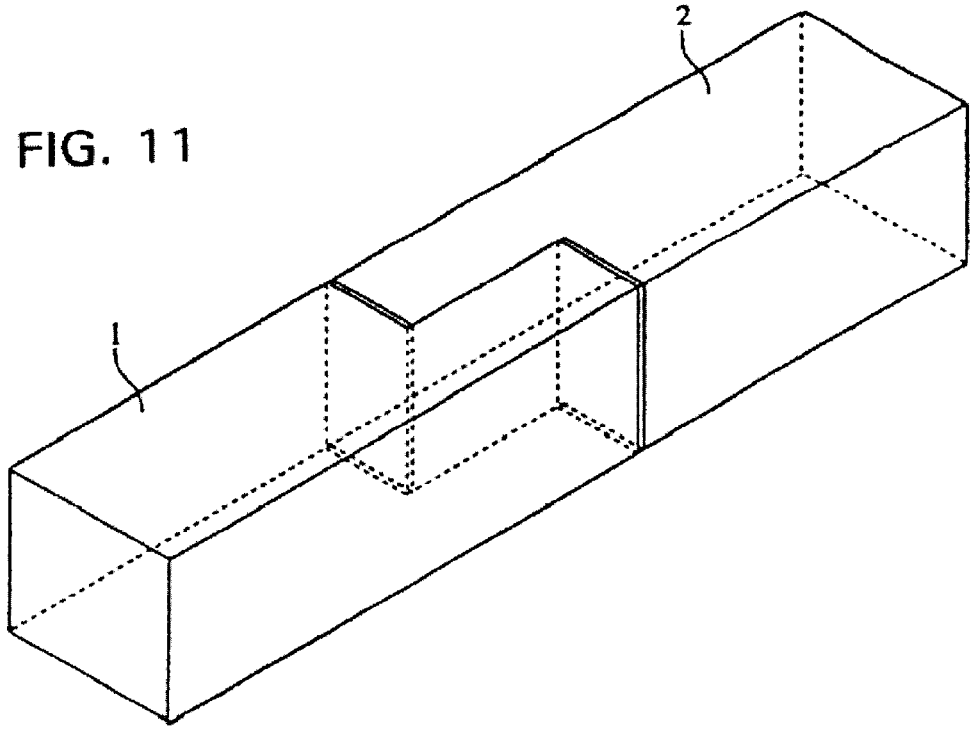
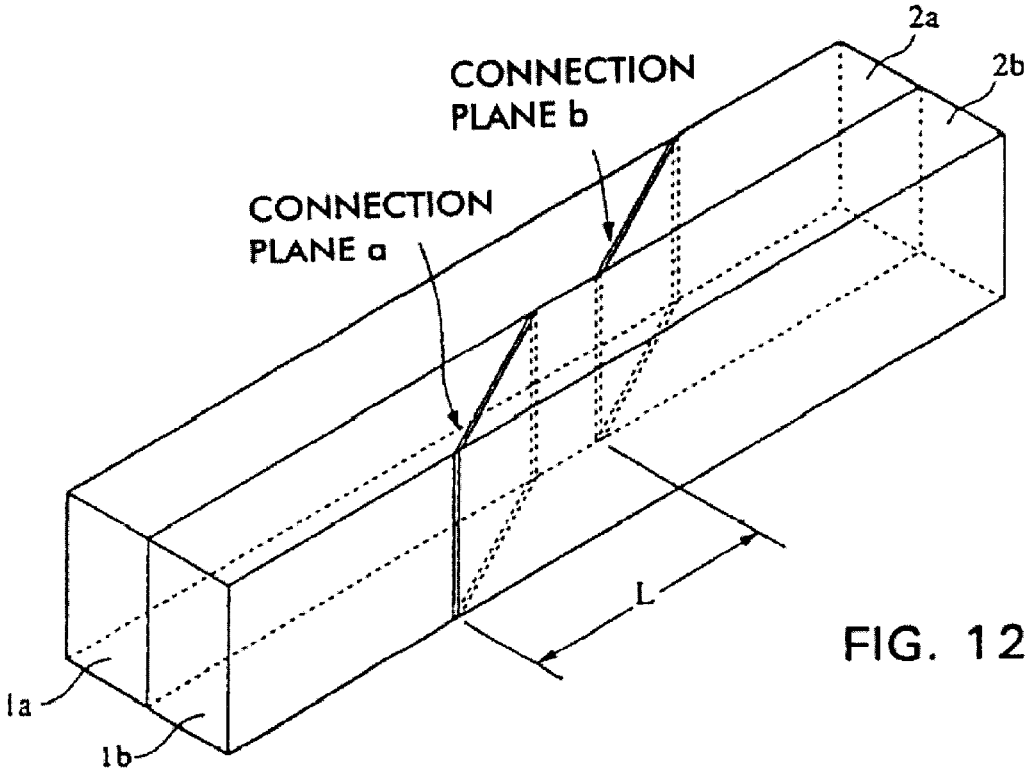
FIG. 12

DIELECTRIC WAVEGUIDE WITH PAIRS OF DIELECTRIC STRIPS CONNECTED IN AN OFF-SET MANNER

CROSS REFERENCE TO RELATED APPLICATION

THE PRESENT APPLICATION IS A DIVISION OF PRIOR APPLICATION SER. NO. 09/114,738, FILED JUL. 13 1998, BY ATSUSHI SAITOH, ET AL. ENTITLED DIELECTRIC WAVEGUIDE, NOW U.S. PAT. No. 6,307, 451, THE DISCLOSURE OF WHICH IS INCORPORATED BY REFERENCE HEREIN.

BACKGROUND OF THE INVENTION

1. Field of the Invention

The present invention relates to a dielectric waveguide suitable for a transmission line or. an integrated circuit used in a millimeter wave band or a microwave band.

2. Description of the Related Art

A dielectric waveguide having a dielectric strip between opposing parallel conductors has been used as a transmission line used in a millimeter wave band or a microwave band. In particular, a dielectric waveguide in which the distance between the conductors is set to a value smaller than ½ of the wavelength of propagating electromagnetic waves to limit radiated waves at a bent portion of a dielectric strip has been used as a nonradiative dielectric waveguide.

Dielectric waveguides of this kind may be used to form millimeter wave circuit modules and may be connected to each other between the modules. In such a case, dielectric strips are connected to each other. Also, if dielectric strip portions are not integrally formed in a single module, dielectric strips are connected to each other.

FIG. 35 shows a conventional connection between two dielectric strips. Upper and lower electrodes are omitted. Members 1 and 2 are dielectric strips. Dielectric waveguides are connected to each other by opposing the end surfaces of the dielectric strips which are perpendicular to the direction of propagation of electromagnetic energy.

Conventionally, polytetrafluoroethylene (PTFE), which has a small dielectric constant and exhibits a low transmission loss, has been used to make a dielectric strip, and hard aluminum having high workability and having a suitable high hardness has been used as a material for forming an electroconductive plate constituting a dielectric waveguide. However, the difference between the linear expansion coefficients of PTFE and aluminum is so large that a gap is formed between the opposed surfaces of dielectric strips of a dielectric waveguide when the dielectric waveguide is used at a temperature lower than the temperature at the time of assembly. Ordinarily, a certain gap can also exist between the opposed surfaces of dielectric strips according to a working tolerance. Since the dielectric constant of air entering such a gap is different from that of the dielectric strips, reflection of an electromagnetic wave occurs at the gap, resulting in a deterioration in the characteristics of the transmission line. Moreover, at the time of assembly of separate dielectric waveguides, a misalignment may occur between the opposed surfaces of the dielectric strips at the connection between the two dielectric waveguides, which depends upon the assembly accuracy. In such a case, reflection is caused at the connection surfaces, also resulting in a deterioration in the characteristics of the transmission line.

FIG. 36 shows the result of calculation of an S11 (reflection loss) characteristic in a 60 GHz band of a dielectric waveguide which has a sectional configuration such as shown in FIG. 1, and in which, referring to FIG. 1, a=2.2 mm, b=1.8 mm, g=0.5 mm, and in FIG. 35, gap=0.2 mm, LL=10 mm, and the dielectric constant $\epsilon r$ of 2.04. The characteristic was calculated by a three-dimensional finite element method. The guide wavelength $\lambda g$ at 60 GHz in this case is 8.7 mm. As shown in FIG. 36, even when the gap is small, about 0.2 mm, the reflection loss is −15 dB or larger.

SUMMARY OF THE INVENTION

It is an object of the present invention to provide a dielectric waveguide designed to avoid the influence of a gap formed at a connection between dielectric strips and to have an improved characteristic.

According to the present invention, there is provided a dielectric waveguide comprising an electromagnetic wave propagation region formed by disposing a plurality of dielectric strip portions along a direction of propagation of an electromagnetic wave. According to one aspect of the present invention, to avoid the influence of reflection at the connection between each adjacent pair of the dielectric strips, adjacent pairs of the electric strips are connected at a plurality of planes spaced apart from each other in the direction of propagation of an electromagnetic wave by a distance corresponding to an odd number multiple of ¼ of the guide wavelength of the electromagnetic wave propagating through the dielectric strips.

Thus, the connection planes between the adjacent pairs of the dielectric strips are spaced apart from each other by the distance corresponding to an odd number multiple of ¼ of the wavelength of an electromagnetic wave in the direction of propagation of the electromagnetic wave to enable electromagnetic waves reflected at the connection planes to be superposed in phase opposition to each other to cancel out, thus reducing the influence of reflection.

According to a second aspect of the present invention, a dielectric strip having a length corresponding to an odd number multiple of ¼ of the guide wavelength of an electromagnetic wave propagating through two dielectric strips is interposed between the two dielectric strips to connect them to each other.

According to a third aspect of the present invention, a third dielectric strip is inserted in part of a connection section of a first dielectric strip and a second dielectric strip and the strips are connected to each other, and the distances between the three connection planes in said connection section are determined so that a wave reflected at the connection plane between the first and third dielectric strips, a wave reflected at the connection plane between the first and second dielectric strips, and a wave reflected at the connection plane between the second and third dielectric strips are superposed with a phase difference of $2\pi/3$ from each other. For example, the phase of a reflected wave at the first-third dielectric strip connection plane is 0; the phase of a reflected wave at the first-second dielectric strip connection plane is $2\pi/3$ (120°); and the phase of a reflected wave at the second-third dielectric strip connection plane is $4\pi/3$ (240°), and if the reflected waves are equal in intensity, each of the real and imaginary part of the resultant wave is zero. Thus, the three reflected waves cancel out.

According to a fourth aspect of the present invention, the distance between the first-second dielectric connection plane and the first-third dielectric strip connection plane is set to ⅙ of the guide wavelength of an electromagnetic wave propagating through the dielectric strips, and the distance between the first-second dielectric strip connection plane and the second-third dielectric strip connection plane is set to ⅙ of the guide wavelength.

According to fifth and sixth aspects of the present invention, to reduce an error in positioning of the opposed surfaces of the dielectric strips at the connection between a pair of dielectric waveguides, the pair of dielectric waveguides are positioned along a direction parallel to the conductor plates and along a direction perpendicular to the electromagnetic wave propagation direction by a projecting portion of one of the conductor plates in the opposed surfaces of the conductor plates at the connection between the pair of dielectric waveguides and a recessed portion of the corresponding opposite conductor plate at a corresponding position.

BRIEF DESCRIPTION-OF THE DRAWINGS

FIG. 11 is a perspective view of another example of the structure of dielectric strip portions;

FIG. 12 is a perspective view of another example of the structure of dielectric strip portions;

Figure 17A:
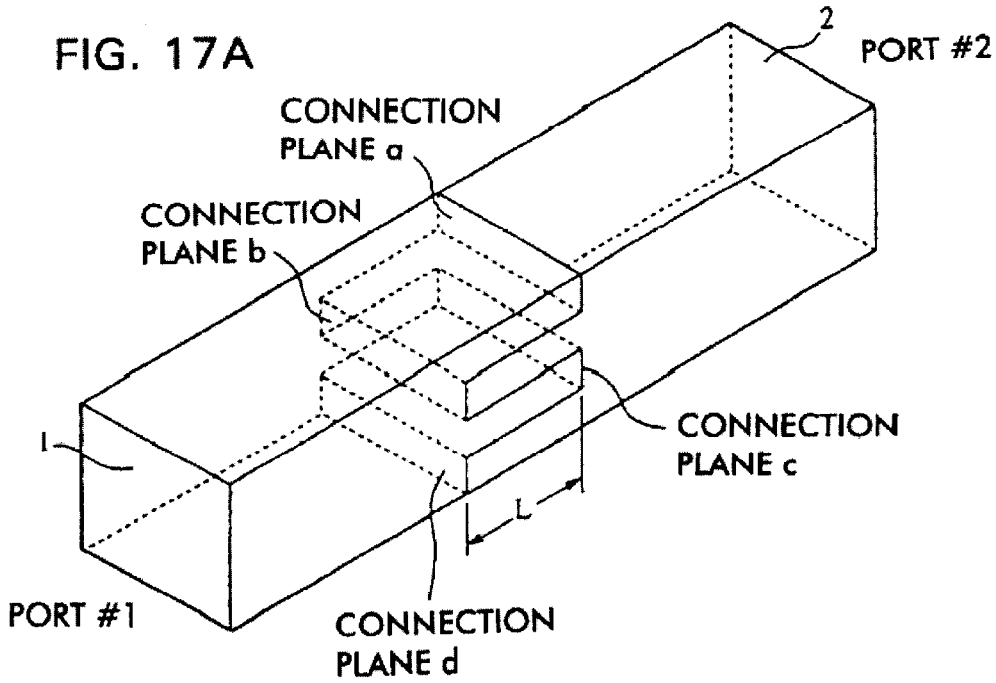
Figure 17B:
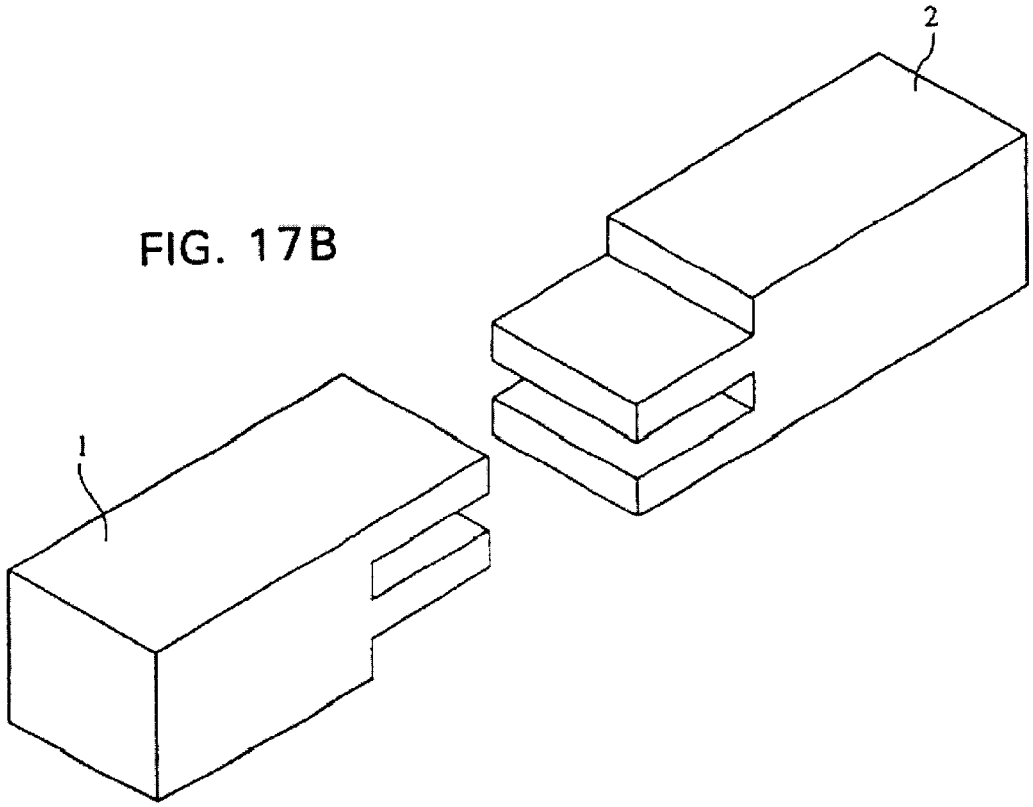
Figure 18:
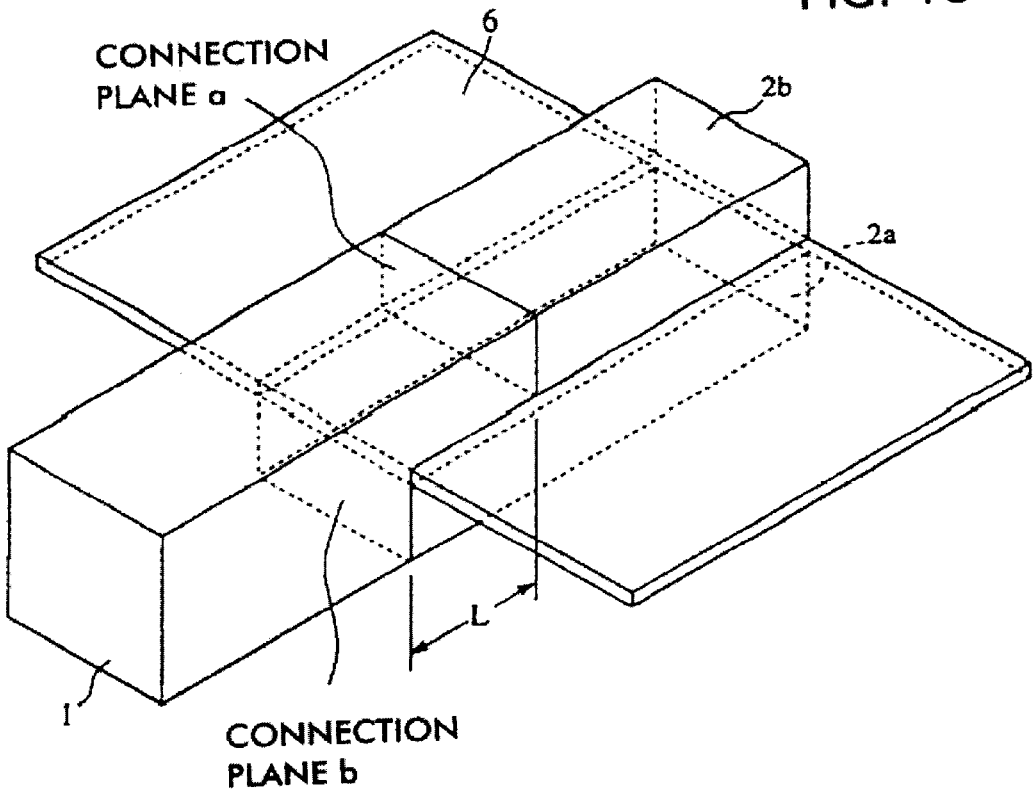
Figure 19:
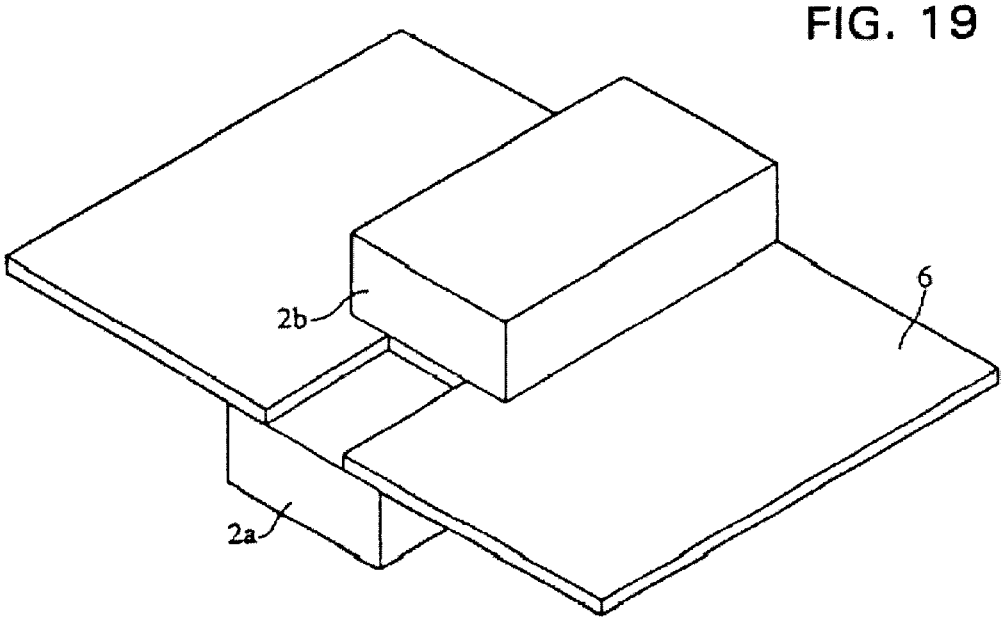
Figure 20:
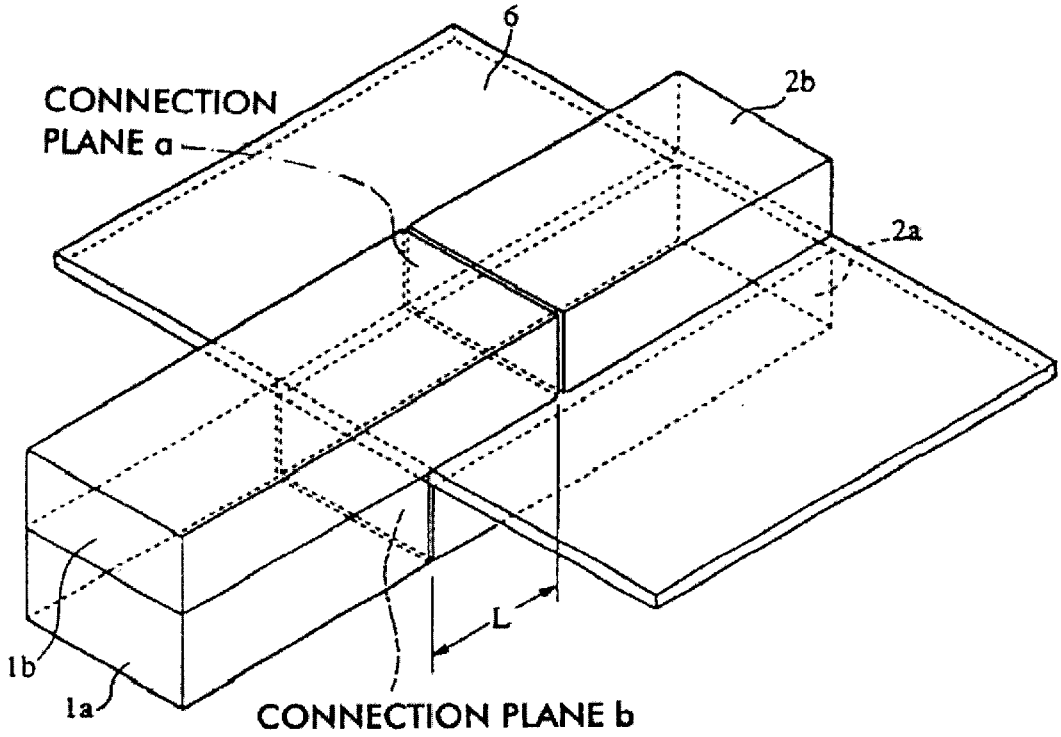
Figure 21:
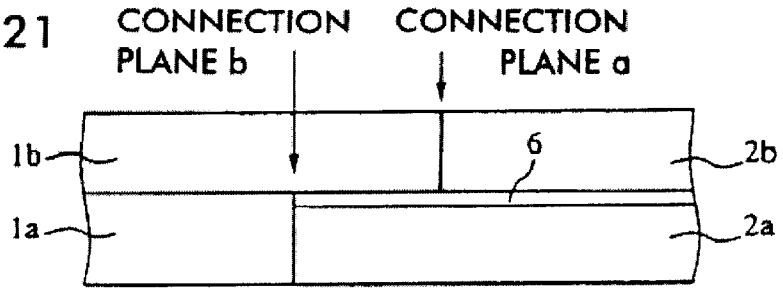
Figure 22:
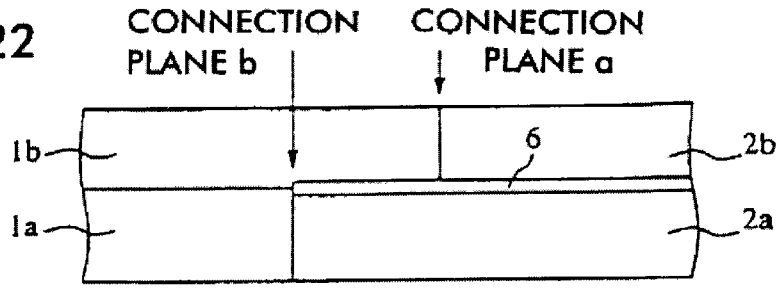
Figure 23:
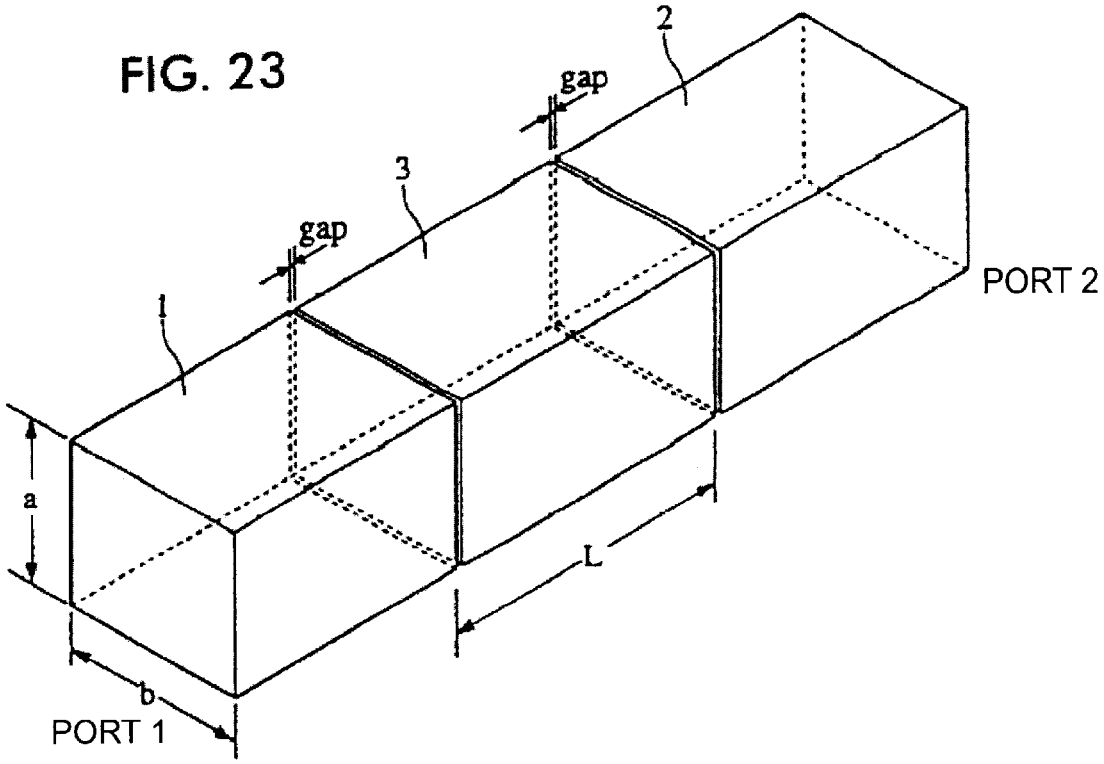
Figure 24:
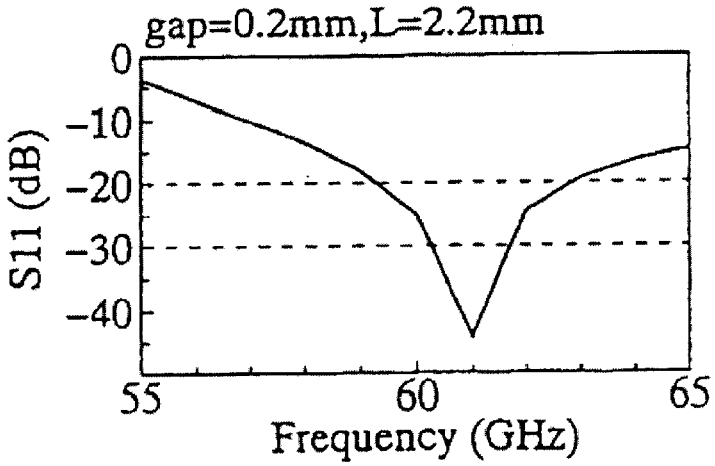
Figure 25A:
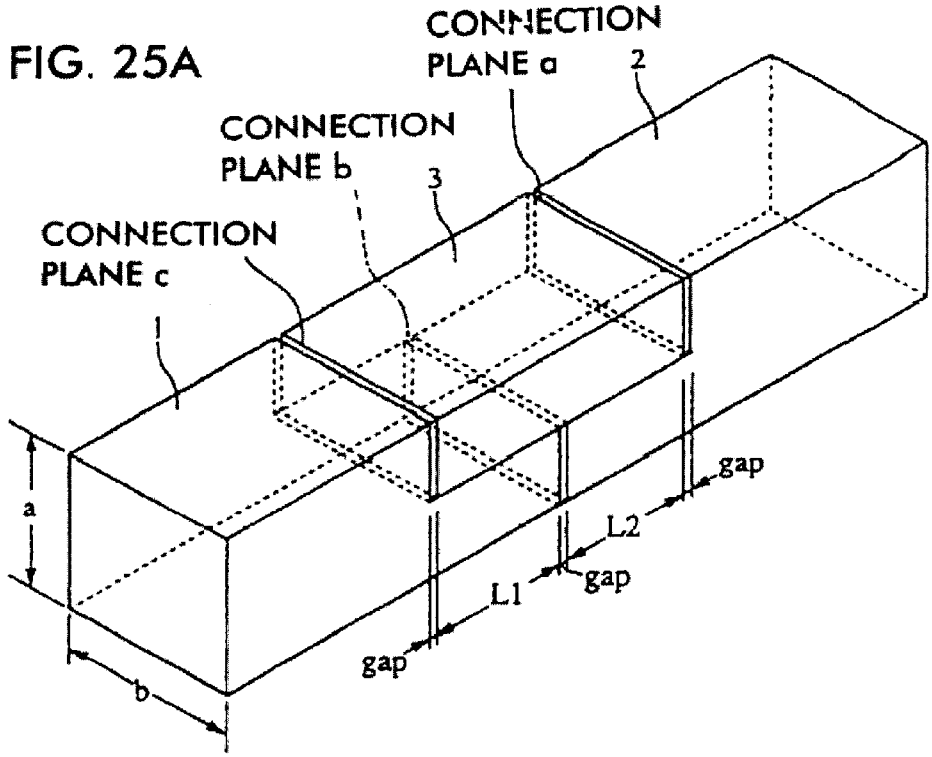
Figure 25B:
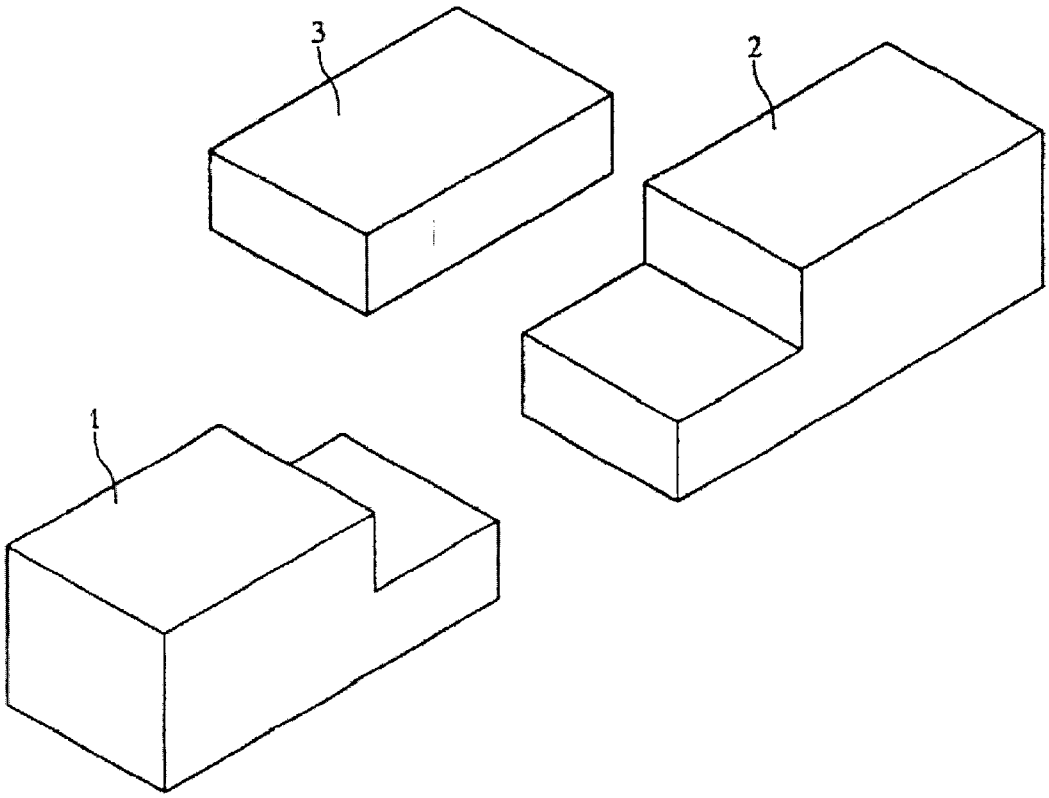
Figure 26:
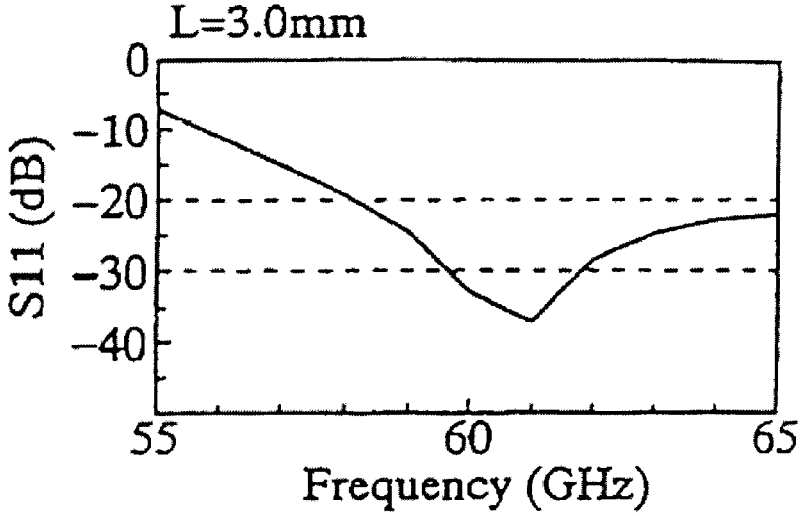
Figure 27B:
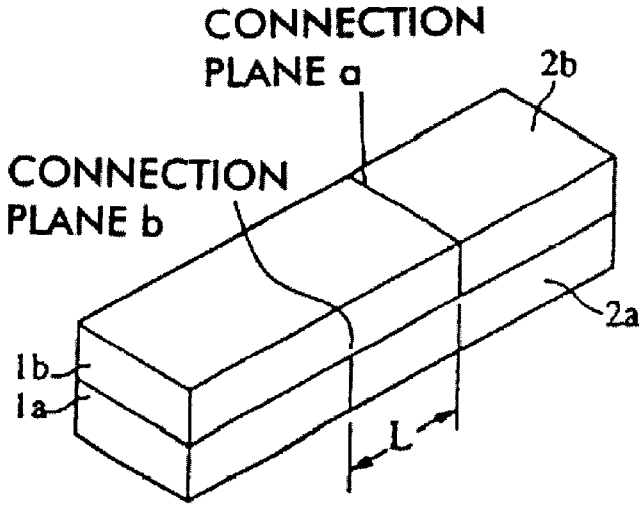
Figure 27A:
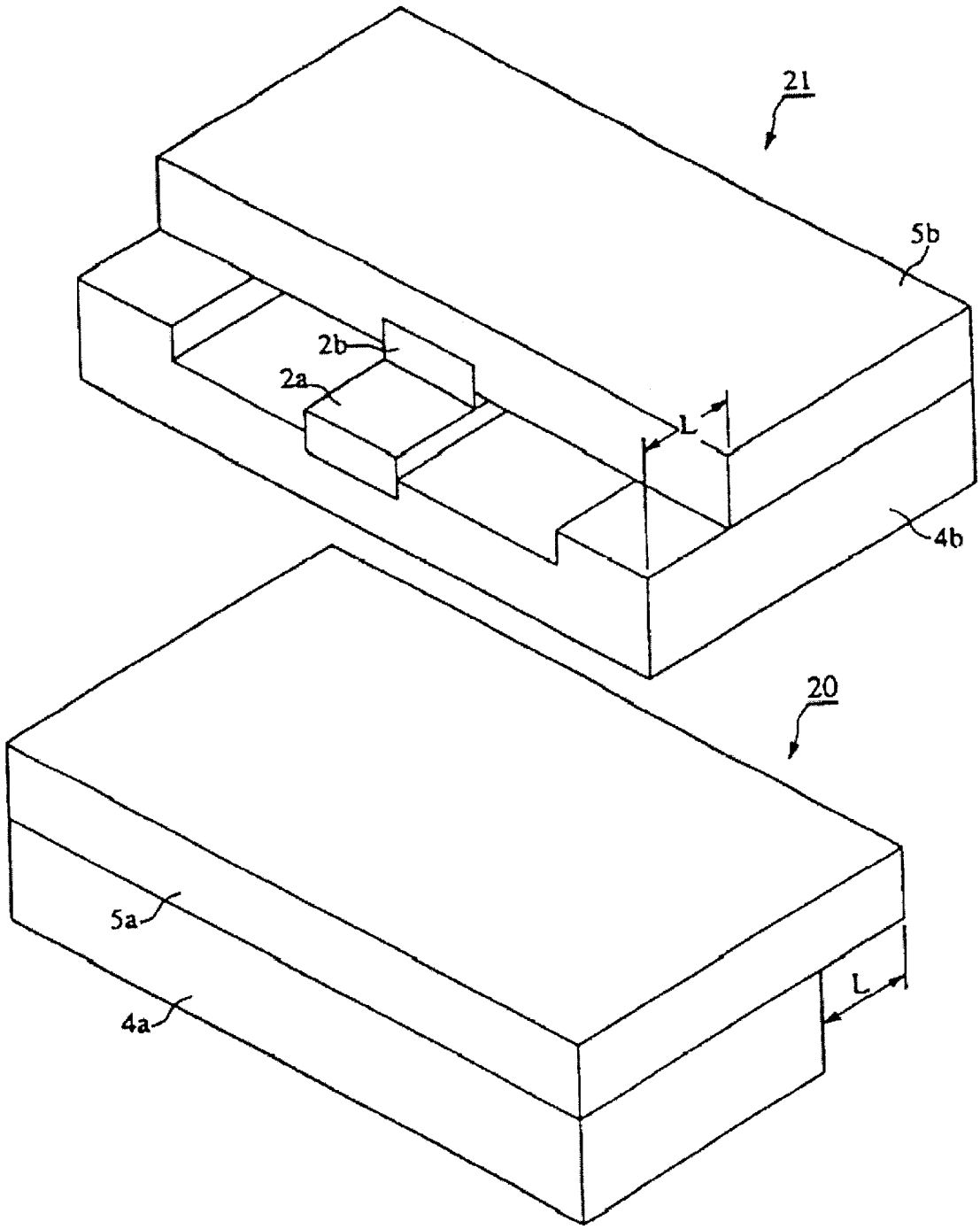
Figure 28:
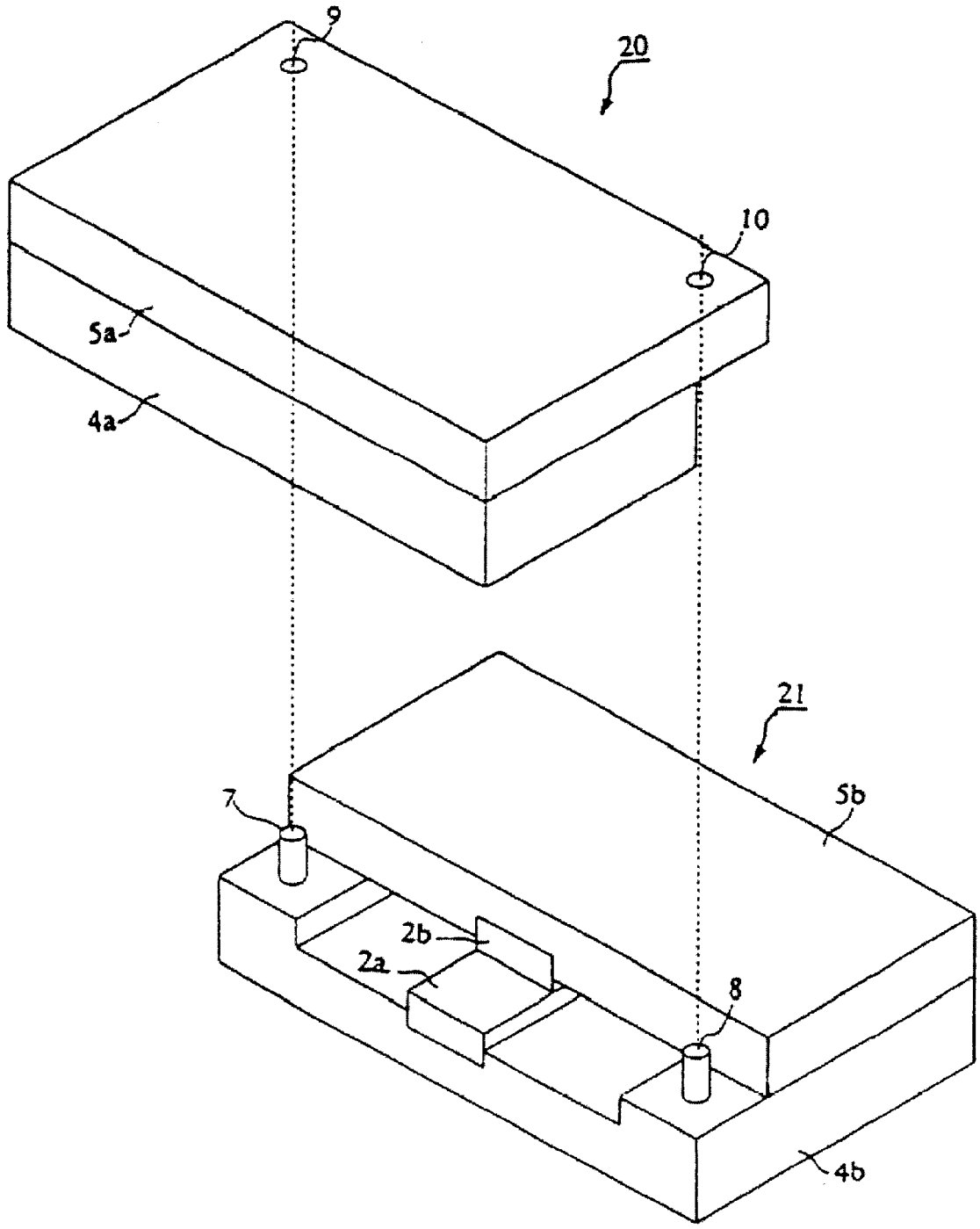
Figure 29:
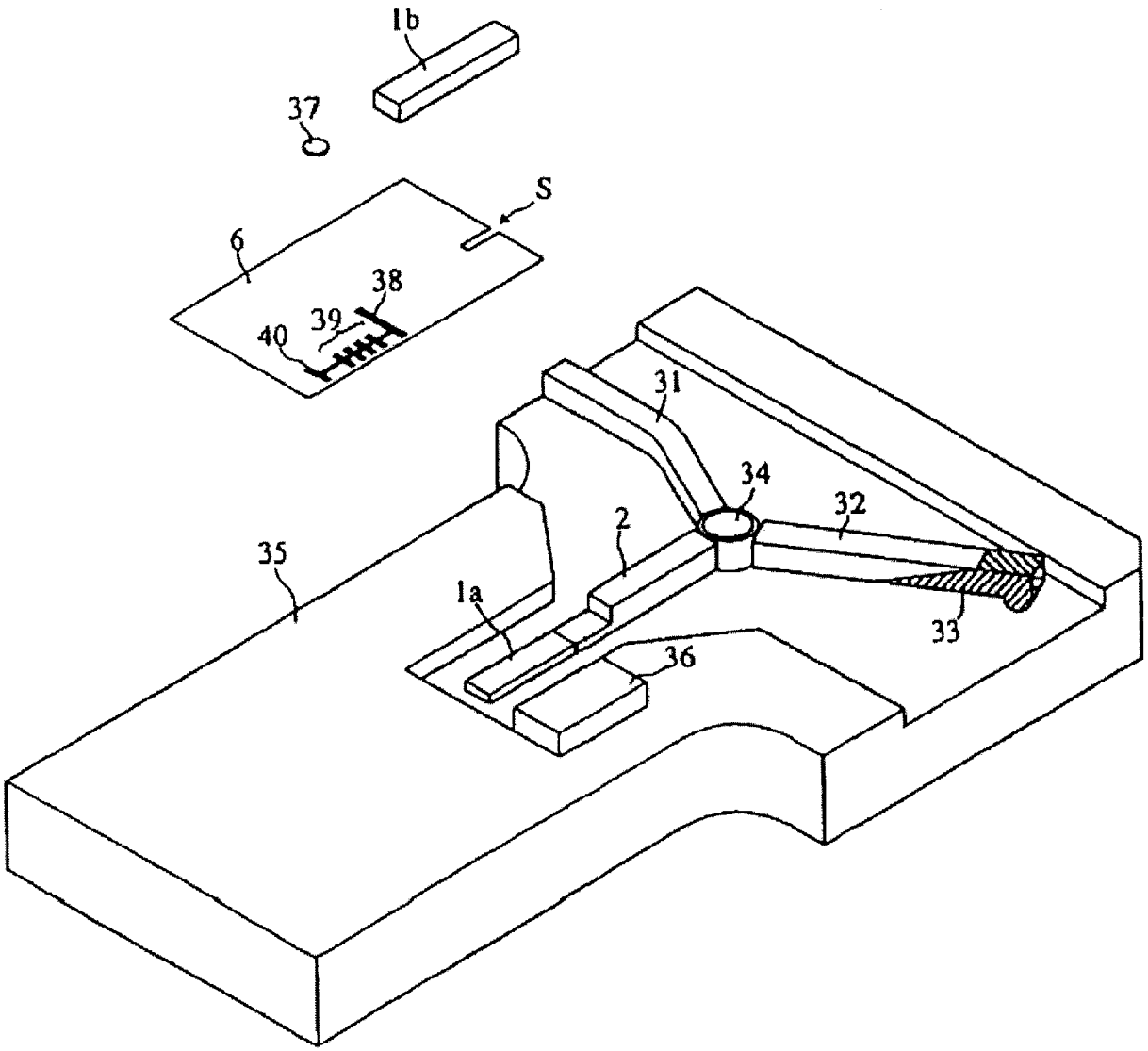
Figure 30:
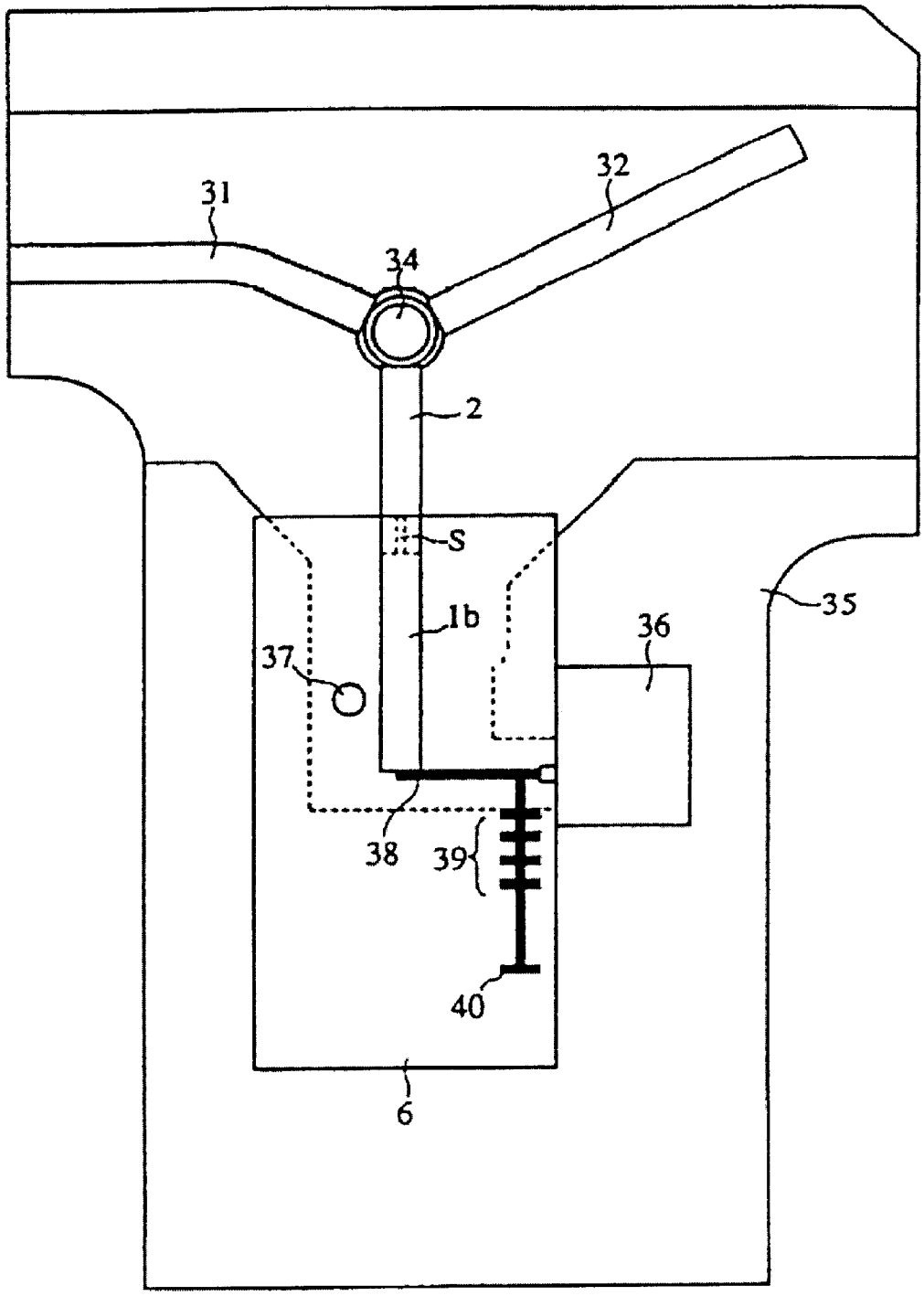
Figure 31A:
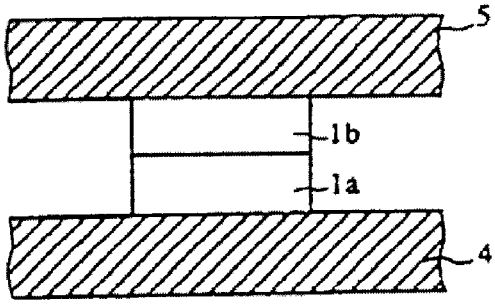
Figure 31B:
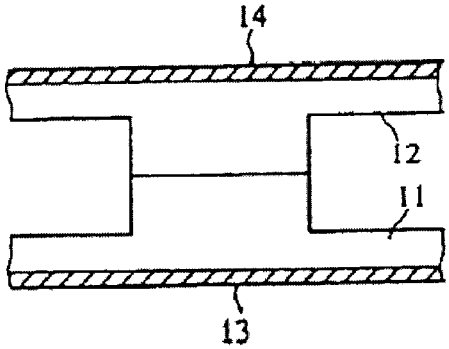
Figure 32:
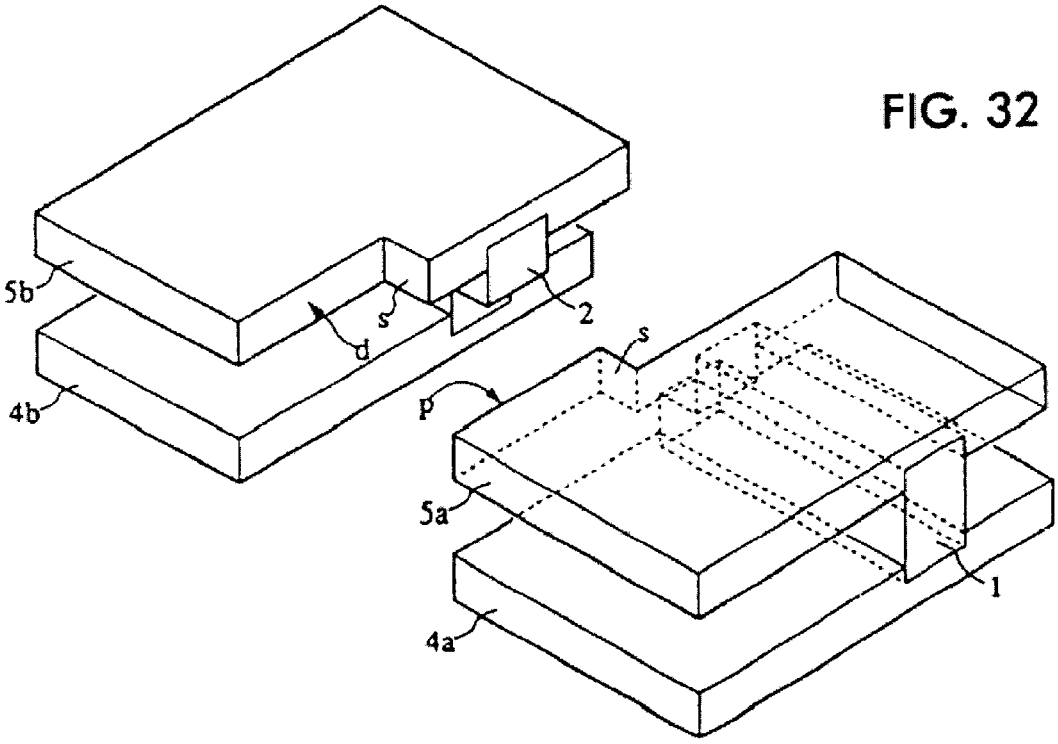
Figure 33:
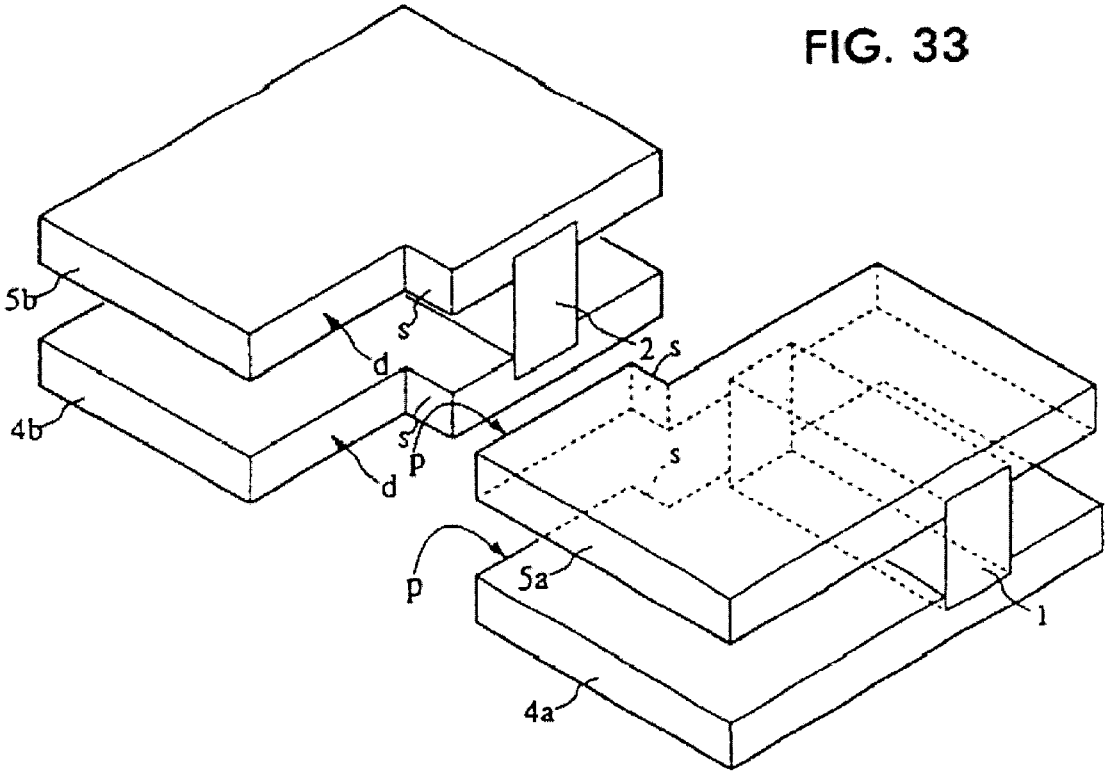
Figure 36:
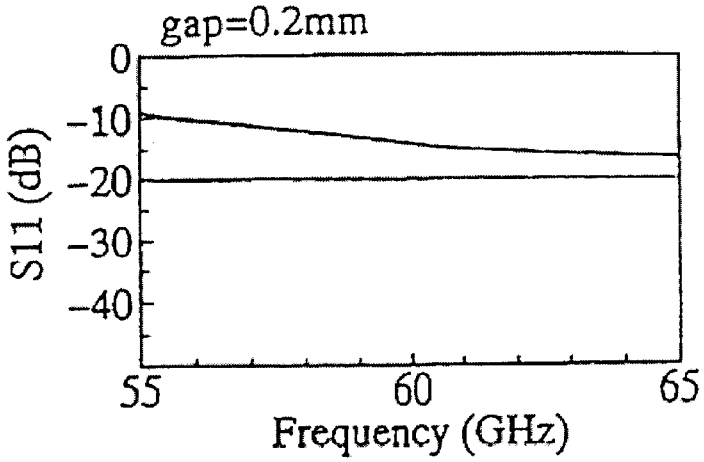
FIG. 36 PRIOR ART
Figure 34:
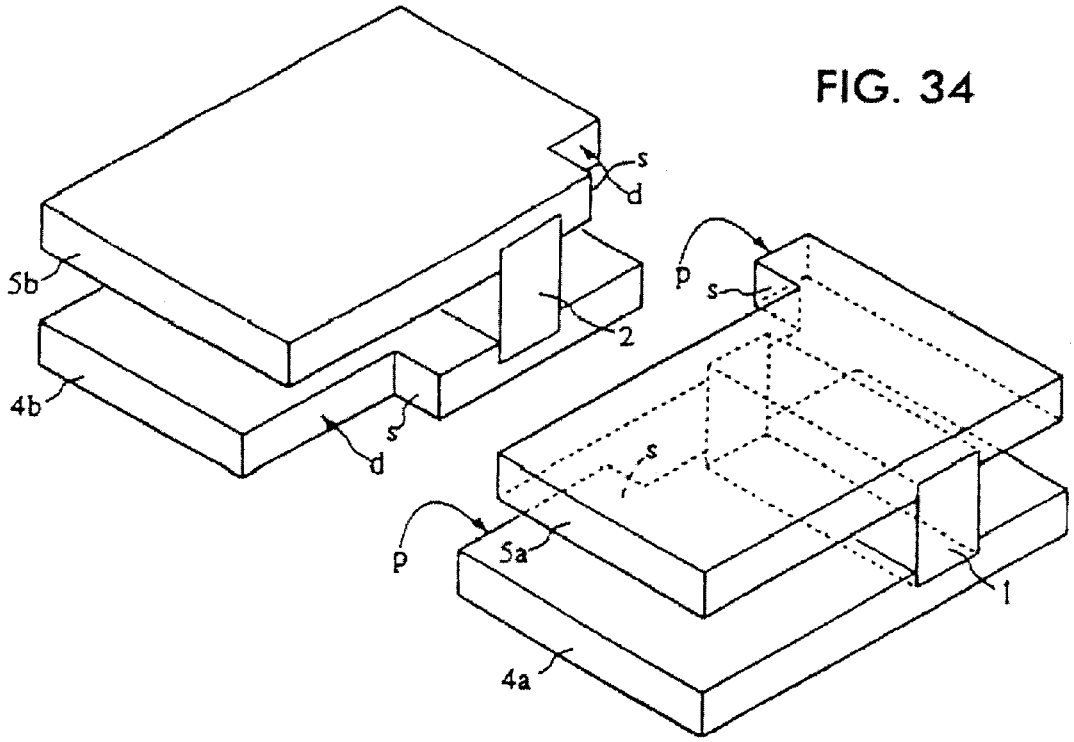
Figure 35:
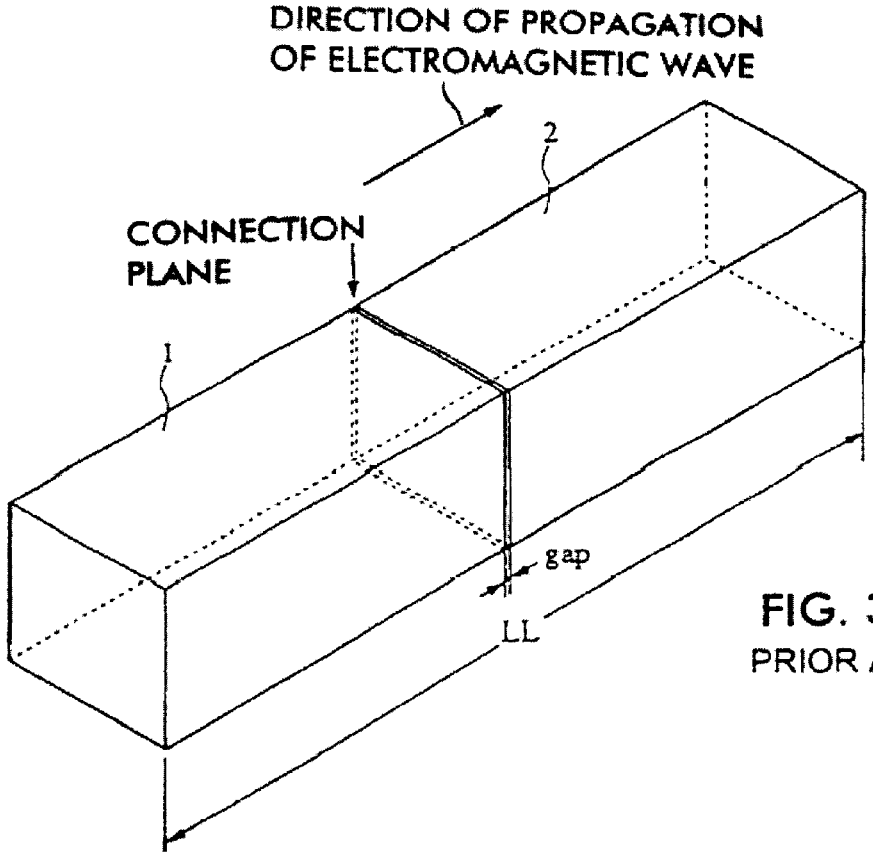
FIG. 35 PRIOR ART

FIGS. 17A and 17B perspective views of another example of the structure of dielectric strip portions;

FIG. 18 is a perspective view of a dielectric waveguide which represents a fifth embodiment of the present invention, the dielectric waveguide being shown without conductor plates;

FIG. 19 is a partial perspective view of another example of the structure of the dielectric waveguide;

FIG. 20 is a perspective view of a dielectric waveguide which represents a sixth embodiment of the present invention, the dielectric waveguide being shown without conductor plates;

FIG. 21 is a cross-sectional view of dielectric strip portions in the dielectric waveguide shown in FIG. 20;

FIG. 22 is a cross-sectional view of another example of the structure of dielectric strip portions in the dielectric waveguide shown in FIG. 20;

FIG. 23 is a perspective view of a dielectric waveguide which represents a seventh embodiment of the present invention, the dielectric waveguide being shown without conductor plates;

FIG. 24 is a graph showing a reflection characteristic of the dielectric waveguide shown in FIG. 23;

FIGS. 25A and 25B are a perspective view and an exploded perspective view, respectively, of a dielectric waveguide which represents an eighth embodiment of the present invention, the dielectric waveguide being shown without conductor plates;

FIG. 26 is a graph showing a reflection characteristic of the dielectric waveguide shown in FIG. 25;

FIGS. 27A and 27B are an exploded perspective view and a perspective view of a dielectric waveguide device which represents a ninth embodiment of the present invention;

FIG. 28 is an exploded perspective view of another example of the dielectric waveguide device of the ninth embodiment;

FIG. 29 is an exploded perspective view of an isolator combined type oscillator which represents a tenth embodiment of the present invention;

FIG. 30 is a plan view of the isolator combined type oscillator shown in FIG. 29;

FIGS. 31A and 31B are cross-sectional views of other examples of the dielectric waveguide device;

FIG. 32 is a diagram showing the structure of connected portions of connection between dielectric waveguides;

FIG. 33 is a diagram showing another example of the structure of connected portions of dielectric waveguides;

FIG. 34 is a diagram showing another example of the structure of connected portions of dielectric waveguides;

FIG. 35 is a perspective view of a conventional dielectric waveguide device shown without conductor plates; and FIG. 36 is a graph showing a reflection characteristic of the dielectric waveguide device shown in FIG. 35.

DESCRIPTION OF THE PREFERRED EMBODIMENTS

Figure 1:
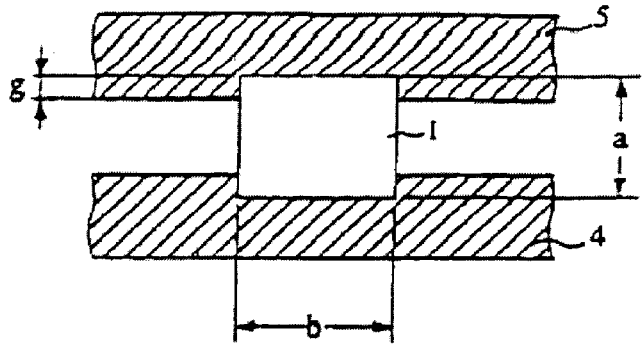
FIG. 1 is a cross-sectional view of an example of a dielectric waveguide in accordance with the present invention.
Figure 2:
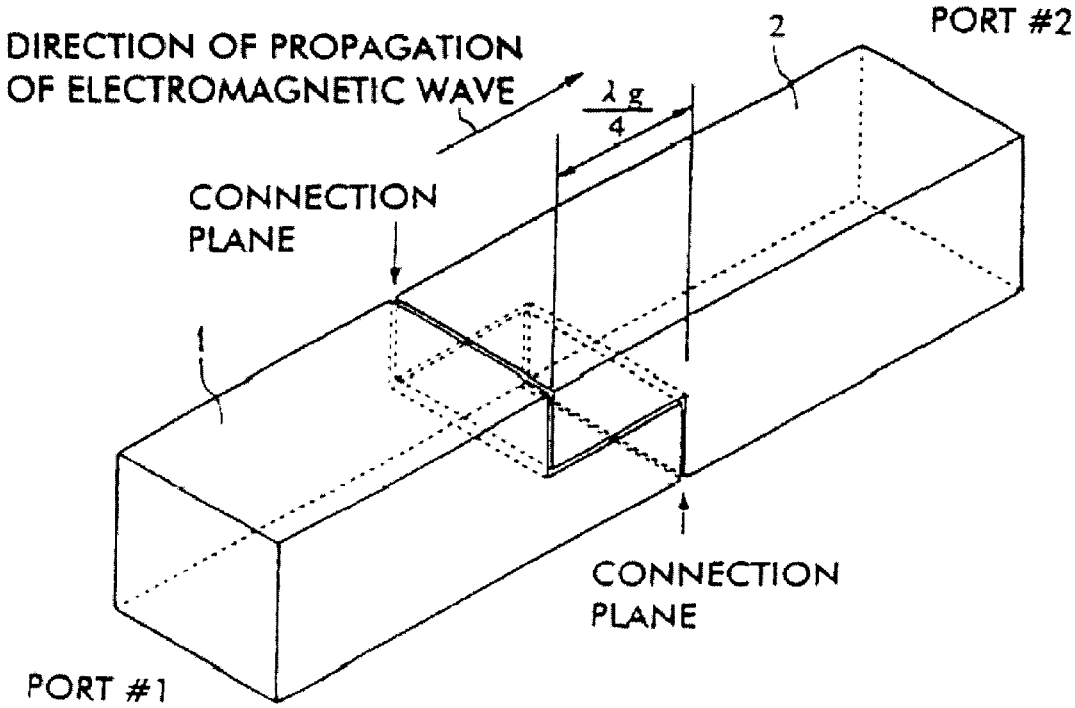
FIG. 2 is a perspective view of dielectric strip portions according to the first aspect of the present invention.

FIGS. 1 and 2 show the configurations of examples of a dielectric waveguide of the first aspect of the present invention, described above. Members 4 and 5 shown in FIG. 1 are conductor plates. A dielectric strip 1 is placed between the conductor plates 4 and 5. In the example shown in FIG. 2, the distance between two connection planes perpendicular to the electromagnetic wave propagation direction is set to $\lambda g/4$, where $\lambda g$ is the guide wavelength. The effect of setting the distance between two connection planes to $\lambda g/4$ is as described below. When a wave reflected at one of the connection planes and another reflected at the other connection plane propagate in one direction, the difference between the electrical lengths of the two waves is $\lambda g/2$ because one of the two waves goes and returns in the section of length $\lambda g/4$, so that the two reflected waves are in phase opposition to each other. Therefore, the two reflected waves can cancel out. In this manner, propagation of reflection waves to a port 1 or port 2 is limited.

Figure 3:
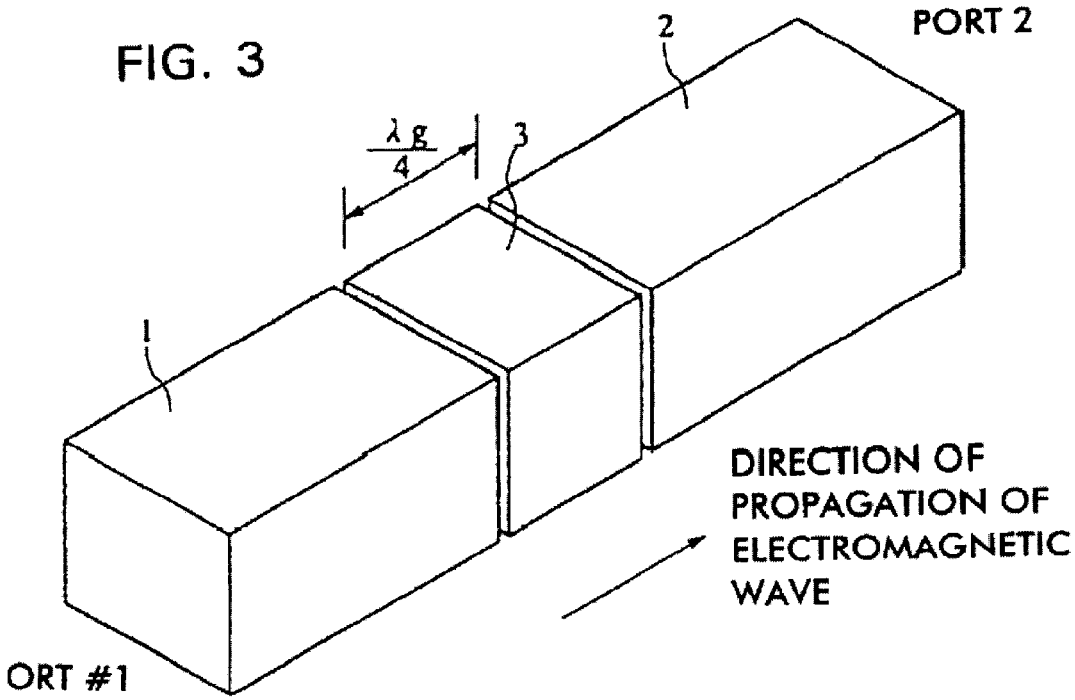
FIG. 3 is a perspective view of dielectric strip portions according to the second aspect of the present invention.

FIG. 3 shows an example of an arrangement of the second aspect of the invention, described above. A state of a dielectric waveguide from which upper and lower dielectric plates are removed is illustrated in FIG. 3. The effect of interposing, between two dielectric strips 1 and 2 to be connected to each other, a dielectric strip 3 having a length corresponding to an odd the number multiple of ¼ of the guide wavelength of an electromagnetic wave propagating through the dielectric strips is as described below. A wave reflected at the dielectric strip 1–3 connection plane and a wave reflected at the dielectric strip 2–3 connection plane are in phase opposition to each other. Therefore, these waves can cancel out and propagation of reflected waves to a port 1 or port 2 is limited.

Figure 4:
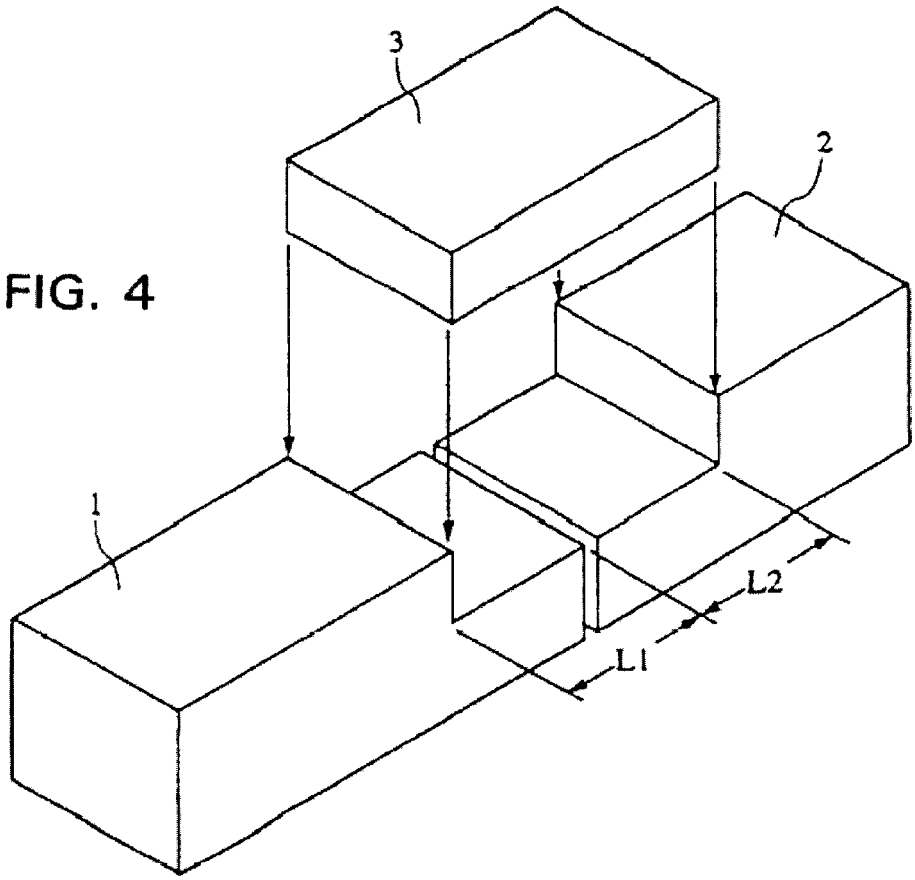
FIG. 4 is a perspective view of dielectric strip portions according to the third aspect of the present invention.

FIG. 4 shows the configuration of an example of a dielectric waveguide of the fourth aspect of the invention, described above. In FIG. 4, conductor plates located above and below the dielectric strips are omitted. Waves reflected at the connection planes can be canceled out by inserting a third dielectric strip 3 in part of a connection section of a first dielectric strip 1 and a second dielectric strip 2 and by setting each of the distances L1 and L2 between the two connection planes to λg/6.

The configuration of a dielectric waveguide which represents a first embodiment or the present invention will be described below with reference to FIGS. 5 to 7.

Figure 5:
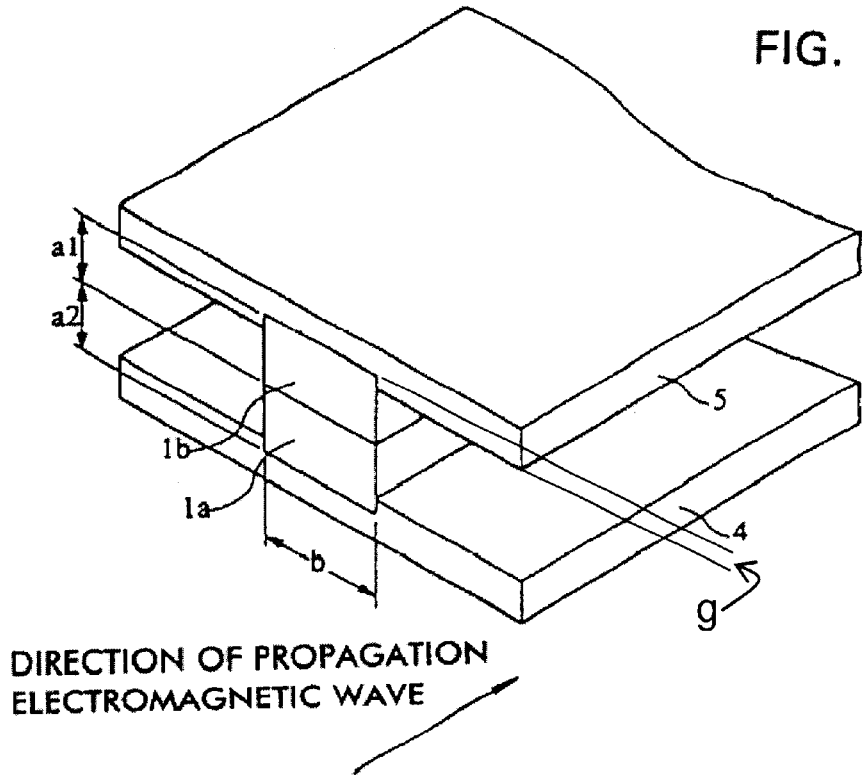
FIG. 5 is a perspective view of a dielectric waveguide which represents a first embodiment of the present invention.

FIG. 5 is a cross-sectional view of an essential portion of the dielectric waveguide. In this embodiment, grooves each having a depth g are respectively formed in conductor plates 4 and 5, dielectric strips 1*a*, 1*b* are respectively set in the grooves, and the conductor plates 4 and 5 with the dielectric strips are positioned relative to each other so that the dielectric strips are opposed to each other.

Figure 6:
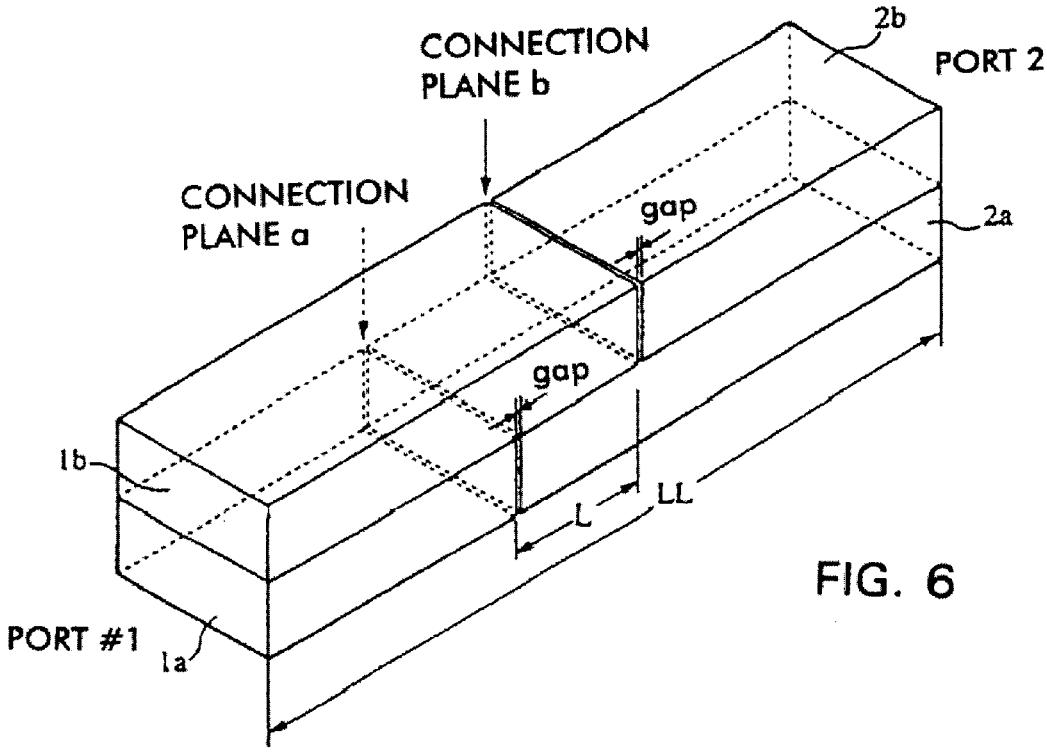
FIG. 6 is a perspective view of dielectric strip portions of the dielectric waveguide shown in FIG. 5.
Figure 7:
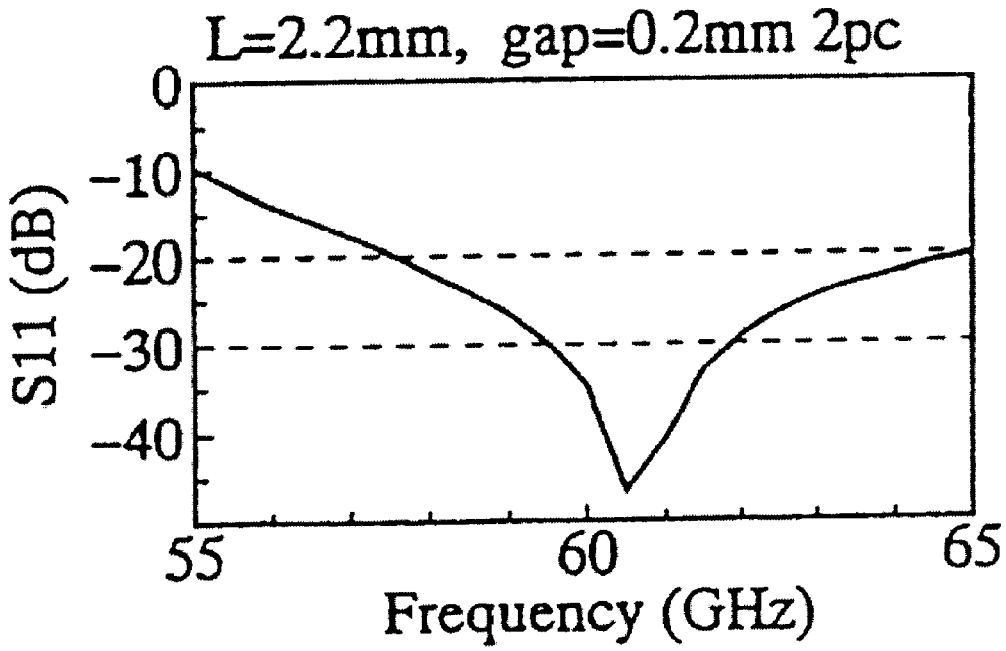
FIG. 7 is a graph showing a reflection characteristic of the dielectric waveguide shown in FIG. 5.

FIG. 6 is a perspective view of the construction of the dielectric strips shown without the upper and lower conductor plates. Referring to FIG. 6, members 1*a* and 2*a* correspond to the dielectric strip provided on the lower conductor plate 4 shown in FIG. 5, and members 1*b* and 2*b* correspond to the dielectric strip provided on the upper conductor plate shown in FIG. 5. The distance L between dielectric strip 1*a*–2*a* connection plane a and dielectric strip 1*b*–2*b* connection plane b is set to λg/4.

If this dielectric waveguide has a cross-sectional configuration such as shown in FIG. 1; a1=a2=1.1 mm, b=1.8 mm, and g=0.5 mm in the structure shown in FIGS. 5 and 6; and the dielectric constant εr of the dielectric strip is 2.04, the guide wavelength λg at 60 GHz is 8.7 mm. Accordingly, the distance L between the two connection planes is set to 2.2 mm. FIG. 7 shows the result of calculation of an S11 (reflection loss) characteristic in a 60 GHz band based a three-dimensional finite element method with respect to a case where gap=0.2 mm and LL=10 mm. As is apparent from the comparison with the result shown in FIG. 36, the reflection characteristic can be markedly improved.

Figure 8A:
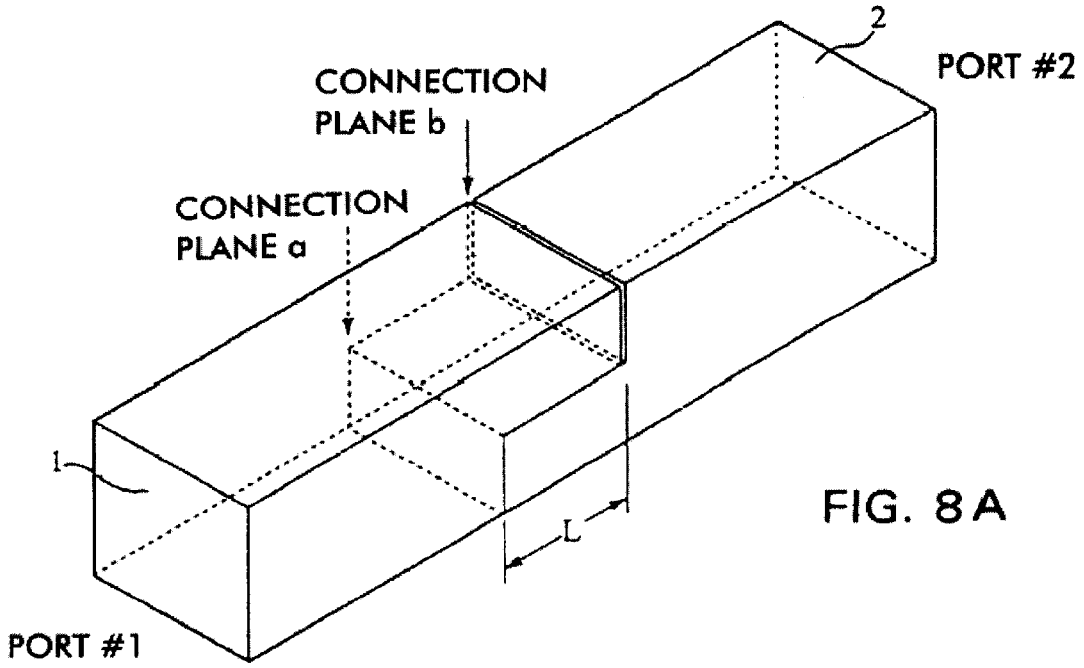
FIGS. 8A and 8B are diagrams showing other examples of the structure of the dielectric strip portions.
Figure 8B:
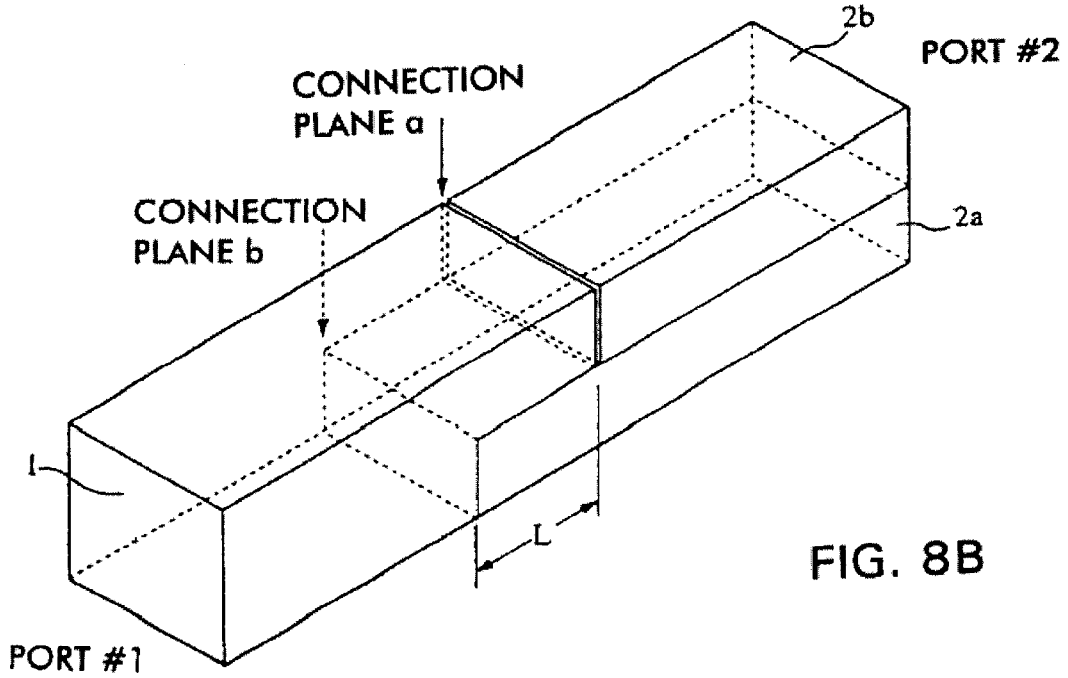

While a pair of half dielectric strips with a boundary parallel to the direction of propagation of electromagnetic waves (into upper and lower halves) are used in the example shown in FIG. 6, dielectric strips 1 and 2 each formed of one integral body as shown in FIG. 8A may alternatively be used. Also, a structure such as shown in FIG. 8B may be used, in which one dielectric strip 1 is formed of one integral body while a pair of half dielectric strips 2*a* and 2*b* are provided on the other side. The same effect of the present invention can also be obtained by using such a structure.

The configuration of a dielectric waveguide which represents a second embodiment of the present invention next be described below with reference to FIGS. 9 to 12.

Figure 9:
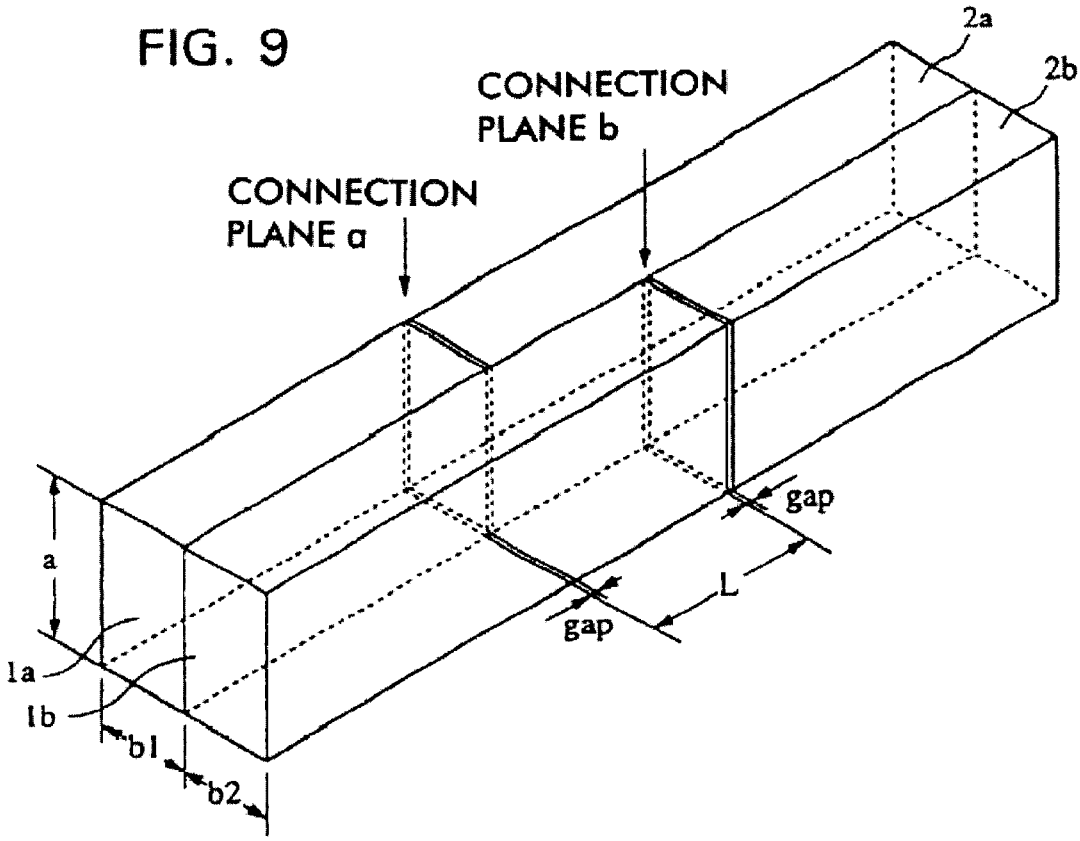
FIG. 9 is a perspective view of the structure of dielectric strip portions in a dielectric waveguide which represents a second embodiment of the present invention.
Figure 10:
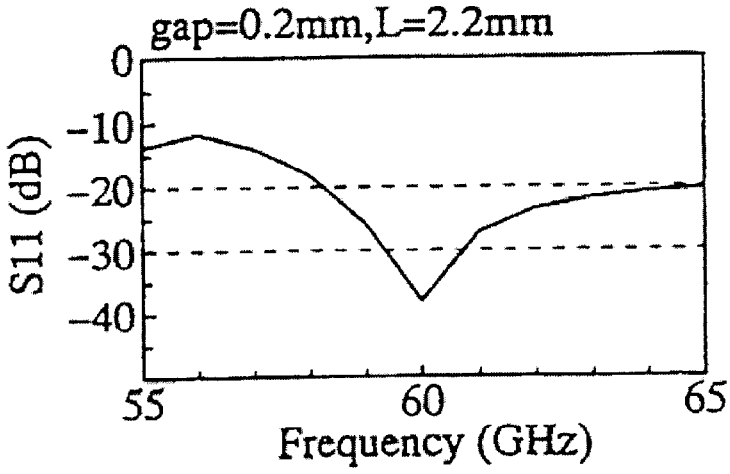
FIG. 10 is a graph showing a reflection characteristic of the dielectric waveguide shown in FIG. 9.

FIG. 9 is a perspective view of the construction of dielectric strips shown without upper and lower conductor plates. In this embodiment, as shown in FIG. 9, each of the dielectric strip 1*a*–2*a* connection plane a and the dielectric strip 1*b*–2*b* connection plane b is perpendicular to each of the upper and lower conductor plates. FIG. 10 shows the result of calculation of a reflection characteristic in the 60 GHz band performed by the three-dimensional finite element method with respect to specifications: a1=2.2 mm, b=b2=0.9 mm, g=0.5 mm (see FIG. 1), gap=0.2 mm, L=2.2 mm, LL=10 mm, and εr=2.04. It can be understood from this result that a suitable reflection characteristic can be obtained at the operating frequency (60 GHz band).

While an example of use of a pair of half dielectric strips with a boundary parallel to the direction of propagation of electromagnetic waves has been described with reference to FIG. 9, dielectric strips 1 and 2 each formed of one integral body may alternatively be used as shown in FIG. 11 to obtain the same effect. According to the structure shown in FIG. 11, the dielectric strips can be manufactured by punching, which is advantageous in massproducibility and in cost reduction effect.

In the above-described embodiments, the two connection planes are set perpendicular to the direction of propagation of electromagnetic waves. However, it is not always necessary to do so. As shown in FIG. 12, the connection planes a and b may be set obliquely while being maintained parallel to each other, with the distance L between the two connection planes in the direction of propagation of electromagnetic waves set to λg/4.

The configuration of a dielectric waveguide which represents a third embodiment of the present invention will next be described below with reference to FIGS. 13 to 15. The third embodiment is arranged in such a manner that a dielectric plate is interposed between two conductor plates, and a planar circuit is formed on the dielectric plate.

Figure 13:
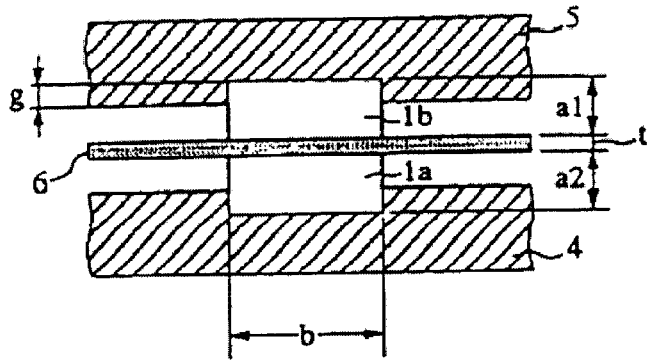
FIG. 13 is a cross-sectional view of dielectric waveguide which represents a third embodiment of the present invention.

FIG. 13 is a cross-sectional view of the structure of this waveguide. Grooves each having a depth g are respectively formed in conductor plates 4 and 5, dielectric strips 1*a* and 1*b* are respectively set in the grooves, and a dielectric plate 6 is interposed between the two dielectric strips. On the dielectric plate 6, conductor patterns for a microstrip line, a coplanar line, a slot lines or the like are formed and electronic components including a semiconductor element or the like are mounted.

Figure 14:
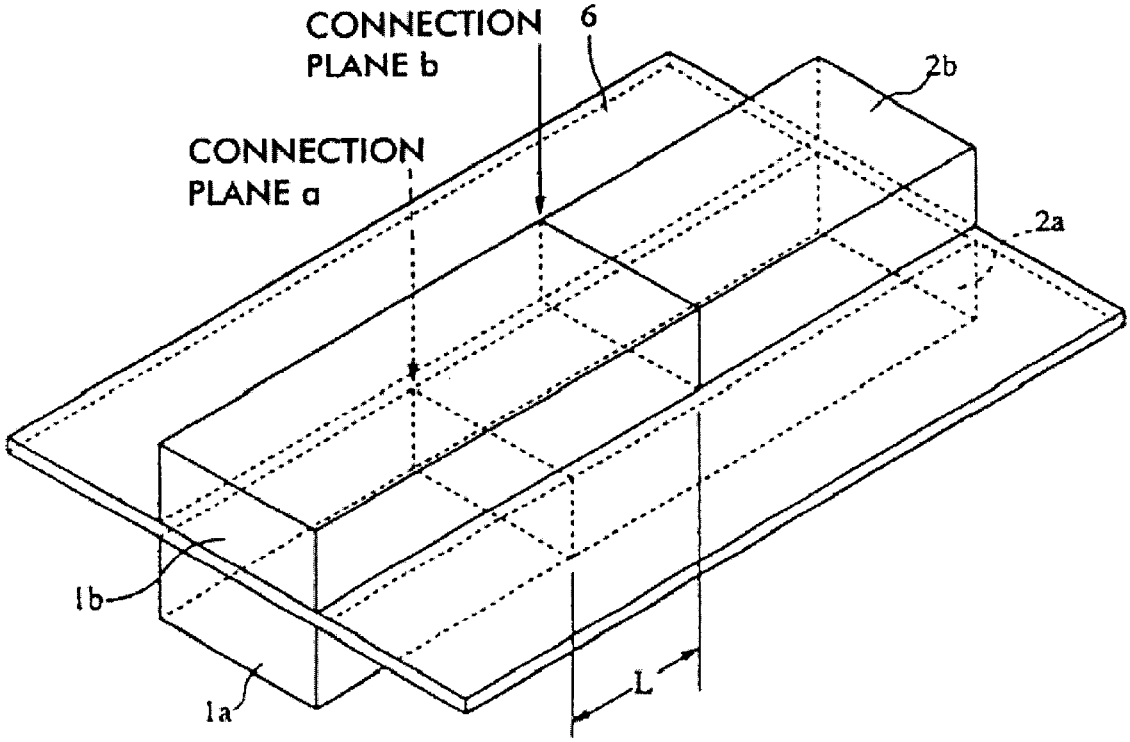
FIG. 14 is a perspective view of the dielectric waveguide shown in FIG. 13, the dielectric waveguide being shown without conductor plates.

FIG. 14 is a perspective view of this structure shown without the upper and lower conductor plates. The distance L between the dielectric strip 1*a*–2*a* connection plane defined on the lower side of the dielectric plate 6 as viewed in FIG. 14 and the dielectric strip 1*b*–2*b* connection plane defined on the upper side of the dielectric plate 6 is set to an odd number multiple of λg/4. Also in this case, a reflection characteristic in the operating band as favorable as those in the first and second embodiments can be obtained.

Figure 15A:
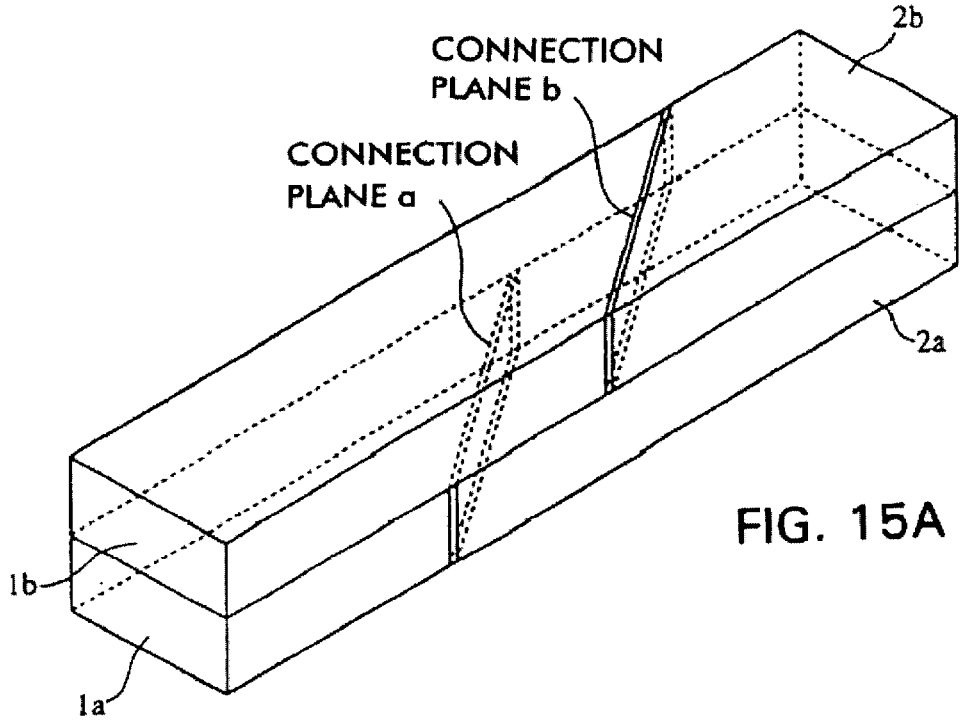
FIGS. 15A and 15B are perspective views of other examples of the structure of dielectric strip portions.
Figure 15B:
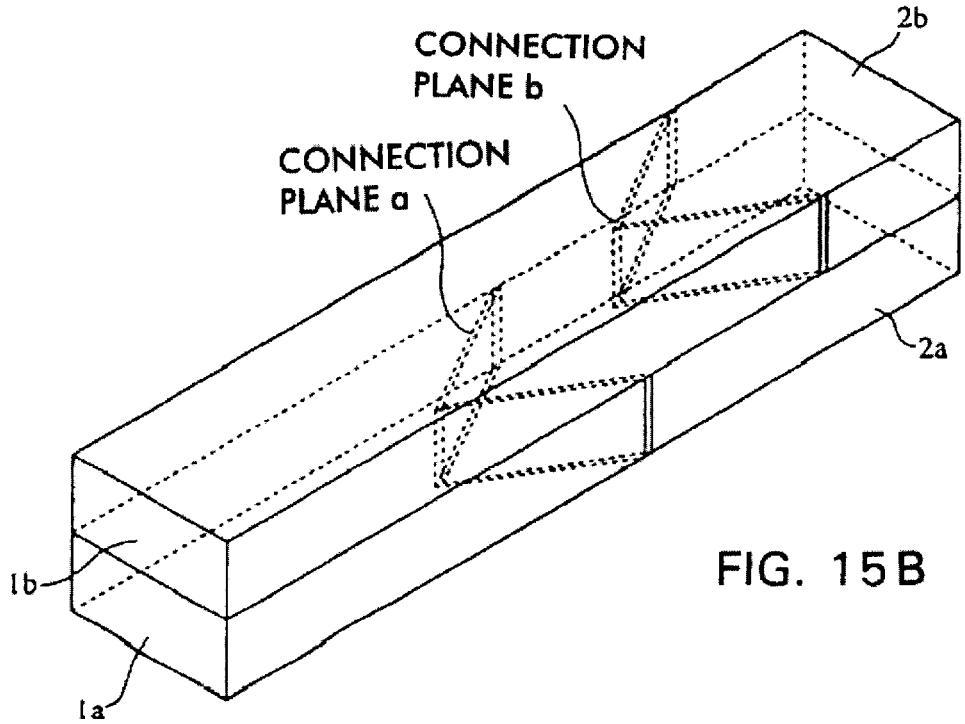

It is not always necessary for the dielectric strips to have connection planes such as those shown in FIG. 14 perpendicular to the direction of propagation of electromagnetic waves. The dielectric strips may have connection planes inclined at a predetermined angle from a plane perpendicular to the direction of propagation of electromagnetic waves, as shown in FIG. 15A or 15B. (In FIGS. 15A and 15B, the dielectric plate between the upper and lower dielectric strips is omitted.) Also in such a case, the arrangement may be such that the distance between the two connection planes in the direction of propagation of electromagnetic waves corresponds to an odd number multiple of λg/4 while the two connection planes are set substantially parallel to each other.

The configurations of dielectric waveguides which represent a fourth embodiment of the present invention will next be described below with reference to FIGS. 16A, 16B, 17A and 17B.

Figure 16A:
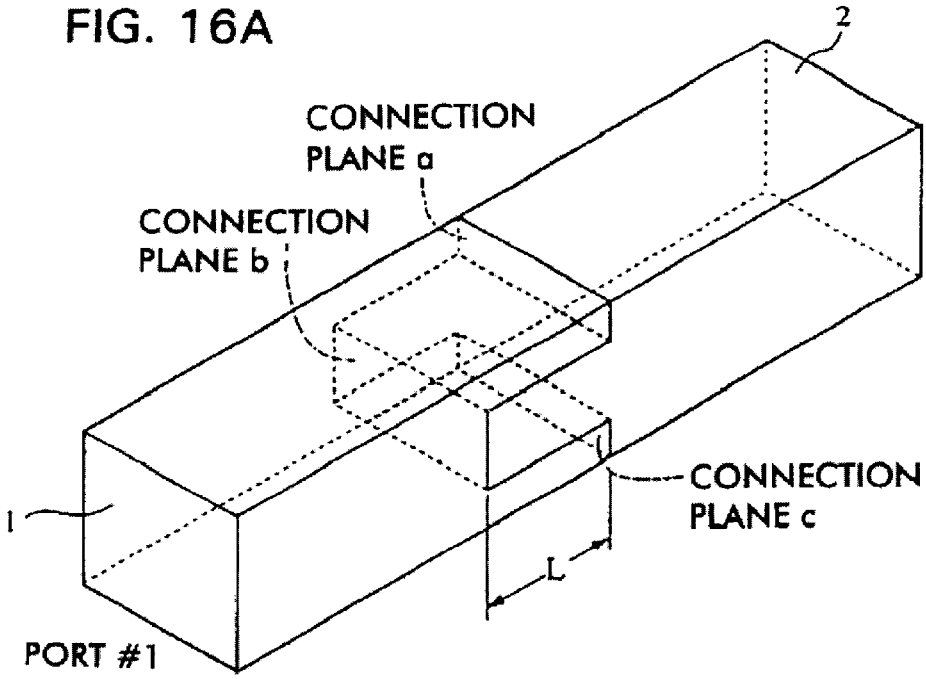
FIGS. 16A and 16B are perspective views of the structure of dielectric strip portions in a dielectric waveguide which represents a fourth embodiment of the present invention.
Figure 16B:
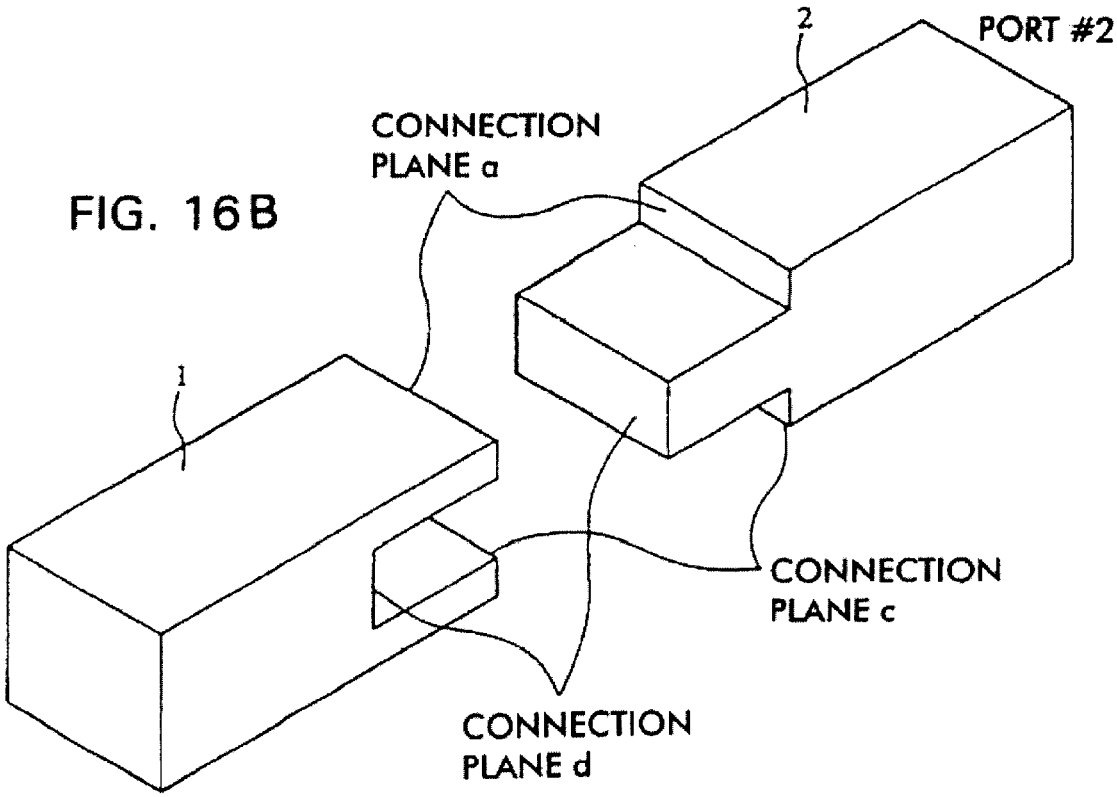

FIG. 16A is a perspective view of dielectric strips shown without upper and lower conductor plates, and shows the connection structure of the dielectric strips. FIG. 16B is an exploded perspective view of the dielectric strips. While the dielectric strips are connected to each other at two connection planes in each of the above-described embodiments, the dielectric strips in this embodiment are connected at three connection planes a, b, and c perpendicular to the direction of propagation of electromagnetic waves. The distance L (see FIG. 16A) between the connection planes is set to an odd number multiple of λg/4.

FIG. 17A is a perspective view of dielectric strips shown without upper and lower conductor plates, and shows the connection structure of the dielectric strips. FIG. 17B is an exploded perspective view of the dielectric strips. In this example, the dielectric strips are connected at four connection planes a, b, c, and d. Even in the case where the number of connection planes is three or more as in this embodiment, propagation of reflected waves to a port #1 or a port #2 can be limited by setting the distance L between the connection planes to an odd number multiple of λg/4 as shown in FIG. 17A.

If such tenon-mortise-like connection is made, the accuracy of relative positioning of the dielectric strips in a direction perpendicular to the axial direction of the dielectric strips can be easily improved.

The configurations of three dielectric waveguides which represent a fifth embodiment of the present invention will next be described below with reference to FIGS. 18 and 19. In a case where a planar circuit is formed together with a dielectric waveguide by using a dielectric plate, a waveguide portion in which the dielectric plate is inserted and another waveguide portion in which the dielectric plate is not inserted are connected at a certain point. The fifth embodiment comprises examples of a matching structure at such a connection point. FIGS. 18 and 19 are perspective views of waveguides shown without upper and lower conductor plates.

In the example shown in FIG. 18, the dielectric constants of the dielectric strips 1, 2*a*, and 2*b*, and the dielectric plate 6 are set approximately equal to each other, or the dielectric constant of the dielectric plate 6 is set slightly smaller than the dielectric constants of the dielectric strips 1, 2*a*, and 2*b*, so that the line impedances of the portion in which the dielectric plate 6 is inserted and the portion in which the dielectric plate 6 is not inserted are approximately equal to each other.

If the dielectric constant of the dielectric plate 6 is different from those of the dielectric strips 1, 2*a*, and 2*b*, a recess (cut) is provided in the dielectric plate 6 as shown in FIG. 19 to set the line impedance at the recess to a middle value between the line impedance of the portion in which the dielectric plate is inserted and the line impedance of the portion in which the dielectric plate is not inserted.

The configurations of a dielectric waveguide which represents a sixth embodiment of the present invention will next be described below with reference to FIGS. 20 to 22.

FIG. 20 is a perspective view in a state where upper and lower conductor plates are removed. This dielectric waveguide differs from that illustrated in FIG. 18 in that four dielectric strips 1*a*, 1*b*, 2*a*, and 2*b* are used. Also in this case, the distance L between the connection plane a and the connection plane b is set to an odd number multiple of λg/4.

FIGS. 21 and 22 are cross-sectional views of dielectric strip portions along the direction of propagation of electromagnetic waves. In the example shown in FIG. 21, the thicknesses of the dielectric strips 1*b* and 2*b* are equal to each other while the thickness of the dielectric strip 1*a* is equal to the sum of the thickness of the dielectric strip 2*a* and the thickness of the dielectric plate 6. In the example shown in FIG. 22, the thickness of the entire dielectric strip 1*b* is equal to that of the dielectric strip 1*a*, the thicknesses of the dielectric strips 2*a* and 2*b* are equal to each other, and the height of the connection plane between the dielectric strips 1*a* and 1*b* corresponds to the center of the end surface of the dielectric plate 6 in the direction of height. When the dielectric strips in the structure shown in FIG. 21 are formed, they can be obtained without post working since the thickness of each dielectric strip is constant. This structure is therefore advantageous in manufacturing facility. The structure shown in FIG. 22 is symmetrical about a horizontal plane, so that the facility with which the dielectric waveguide is designed is improved.

FIG. 23 is a perspective view showing the configuration of a dielectric waveguide which represents a seventh embodiment of the present invention. In FIG. 23, only dielectric strips are shown, without upper and lower conductor plates. A dielectric strip 3 having a length L corresponding to an odd number multiple of λg/4 is interposed between two dielectric strips 1 and 2 which are to be connected to each other. In the dielectric waveguide thus constructed, a wave reflected at the dielectric strip 1–3 connection plane and a wave reflected at the dielectric strip 2–3 connection plane are superposed in phase opposition to each other to be canceled out. In this manner, reflected waves propagating to a port 1 and to a port 2 are reduced.

FIG. 24 shows the result of calculation of a reflection characteristic in the 60 GHz band of the dielectric waveguide shown in FIG. 23. The characteristic was calculated by the three-dimensional finite element method with respect to specifications: a=2.2 mm, b=1.8 mm, g=0.5 mm (see FIG. 1), gap=0.2 mm, L=2.2 mm, overall length=10 mm, and $\epsilon r$=2.04. Thus, an improved reflection characteristic in the operating 60 GHz band can be obtained.

When the dielectric strips in the structure shown in FIG. 23 are formed, each dielectric strip can be worked by being cut along a plane perpendicular to its axial direction. Thus, the facility with which the dielectric waveguide is manufactured can be improved.

FIGS. 25A and 25B are diagrams showing a dielectric waveguide which represents an eighth embodiment of the present invention. FIG. 25A is a perspective view of dielectric strips shown without upper and lower conductor plates, and FIG. 25B is an exploded perspective view of the dielectric strips. As shown in FIGS. 25A and 25B, a third dielectric strip 3 is inserted in a connection section of first and second dielectric strips 1 and 2, and each of the distances L1 and L2 between two pairs of connection planes is set to λg/6, thereby enabling waves reflected at the connection planes to cancel out.

FIG. 26 shows the result of calculation of a reflection characteristic in the 60 GHz band of the dielectric waveguide shown in FIGS. 25A, 25B. The characteristic was calculated by the three-dimensional finite element method with respect to specifications: a=2.2 mm, b=1.8 mm, g=0.5 mm (see FIG. 1), gap=0.2 mm, and $\epsilon r$=2.04, L1=L2, and L1+L2=L=3.0. The guide wavelength λg at 60 GHz is 8.7 mm. It can be understood from this result that an improved reflection characteristic at the operating frequency (60 GHz band) can be obtained even in the case where there are three connection planes.

FIGS. 27A, 27B and 28 are exploded perspective views of a dielectric waveguide device which represents a ninth embodiment of the present invention. In this embodiment, each of components of a mixer or an oscillator is separately manufactured and the prepared components are combined to form a dielectric waveguide device. FIG. 27A is a diagram showing a state of two components 20 and 21 before assembly, and FIG. 27B is a perspective view of the connection structure of dielectric strip portions used in the two components 20 and 21. The component 20 has conductor plates 4*a* and 5*a* and has dielectric strips 1*a* and 1*b* provided between the conductor plates 4*a* and 5*b*, as shown in FIG. 27B. Similarly, the component 21 has dielectric strips 2*a* and 2*b* provided between conductor plates 4*b* and 5*b* as best shown in FIG. 27A. A planar circuit on a dielectric plate (now shown) is formed inside these components 20 and 21 according to one's need. In the component 20, the end surface of the conductor plate 5*a* protrudes by L beyond the end surface of the conductor plate 4*a*. In the component 21, the end surface of the conductor plate 4*b* protrudes by L beyond the end surface of the conductor plate 5*b*. Correspondingly, the distance between the dielectric strip 1*b*–2*b* connection plane a and the dielectric strip 1*a*–2*a* connection plane b is set to L, as shown in FIG. 27B. When these two components 20 and 21 are combined, they are positioned relative to each other along the vertical direction as viewed in the figure by abutment of the lower surface of the protruding portion of the conductor plate 5*a*-and the upper surface of the protruding portion of the conductor plate 4*b* and by abutment of the upper surface of the protruding portion of the dielectric strip 2*a* and the lower surface of the protruding portion of the dielectric strip 1*b*. The two components 20 and 21 are also positioned along the electromagnetic wave propagation direction by abutment of the end surfaces of the dielectric plates 4*a* and 5*a*, and 4*b* and 5*b*, and by abutment of the end surfaces of the dielectric strips 1*a* and 1*b*, and 2*a* and 2*b*.

FIG. 28 shows an example of positioning in a dielectric waveguide along a direction perpendicular to the electromagnetic wave propagation direction and along a horizontal direction as viewed in the figure. Positioning pins 7 and 8 are provided on the conductor plate 4*b*, and positioning holes 9 and 10 are formed in corresponding positions in the conductor plate 5*a*. The components 20 and 21 are positioned by fitting the positioning pins 7 and 8 projecting from the component 21 to the positioning holes 9 and 10 of the component 20.

FIG. 29 is an exploded perspective view of an oscillator with which an isolator is integrally combined, and which represents a tenth embodiment of the present invention, and FIG. 30 is a plan view of components in a superposed state. Components 2, 31, and 32 shown in FIGS. 29 and 30 are dielectric strips, and a component 34 is a ferrite disk. These components are disposed between a conductor plate 35 and another conductor plate (not shown) opposed to each other. A resistor 33 is provided at a terminal of the dielectric strip 32. Further, a magnet for applying a do magnetic field to the ferrite disk 34 is provided. These components form an isolator.

An end portion of the dielectric strip 2 is formed so as to have a step portion. A dielectric strip 1*a* is placed on the conductor plate 35 continuously with the step portion of the dielectric strip 2. A dielectric plate 6 is placed on the end step portion of the dielectric strip 2, on the dielectric strip 1*a* and on a portion of the conductor plate 36. The dielectric plate 6 has a cut portion S at its one end. The cut portion S corresponds to the step portion of the dielectric strip 2. A dielectric strip 1*b* is placed at a position on the dielectric plate 6 opposite from the dielectric strip 1*a* (see FIG. 29), thus forming a structure in which the dielectric plate 6 is interposed between the upper and lower dielectric strips. This structure enables impedance matching by setting the impedance of the line at the step portion of the dielectric strip 2 as a middle value between the impedance of the line at the dielectric strip 1*a* and the impedance of the line at the dielectric strip 2.

The length of the dielectric strip 1*b* is approximately equal to the sum of the dielectric strip 1*a* and the length of the step portion of the dielectric strip 2. The length of the step portion at the end of the dielectric strip 2 is set an odd number multiple of ¼ of the guide wavelength of an electromagnetic wave propagating through the dielectric strips. Waves reflected at the two connection planes between the dielectric strip 2 and the dielectric strips 1*a* and 1*b* are thereby made to cancel out.

On the dielectric plate 6, an excitation probe 38, a low-pass filter 39, and a bias electrode 40 are formed. A Gunn diode block 36 is provided on the conductor plate 35, and a Gunn diode is connected to the excitation probe 38 on the dielectric plate 6, and the excitation probe 38 is positioned at the ends of the dielectric strips 1*a* and 1*b*. A dielectric resonator 37 is also provided on the dielectric plate 6. The dielectric resonator 37 is disposed close to the dielectric strips 1*a* and 1*b* to couple with the same.

In the thus-constructed oscillator, a bias voltage is applied to the bias electrode 40 to supply a bias voltage to the Gunn diode. The Gunn diode thereby oscillates, generating a signal, which propagates through the dielectric strips 1*a* and 1*b*, the dielectric strips 1*a* and 1*b* and the nonradiative dielectric waveguide formed of the dielectric strips 1*a* and 1*b* and the upper and lower conductor plates via the excitation probe 38. This signal propagates in the direction from the dielectric strip 2 toward the dielectric strip 31. The dielectric resonator 37 stabilizes the oscillation frequency of the Gunn diode. The low-pass filter 39 suppresses leakage of a high-frequency signal to the bias electrode 40.

A reflected wave from the dielectric strip 31 is guided in the direction toward the dielectric strip 32 by the operation of the isolator and is terminated by the resistor 33 in a non-reflection manner as shown in FIG. 29. Therefore, no reflected wave returns from the dielectric strip 31 to the Gunn diode. Also, waves reflected at the two connection planes between the dielectric strips 1*a* and 1*b* and the dielectric strip 2 cancel out and do not return to the Gunn diode. Thus, an oscillator having stabilized characteristics can be obtained.

FIG. 32 shows another example of the connection structure of dielectric waveguides. Referring to FIG. 32, one dielectric waveguide has grooves formed in conductor plates 4*a* and 5*a*, and has a dielectric strip 1 fit to the grooves. Another dielectric waveguide has grooves formed in conductor plates 4*b* and 5*b*, and has a dielectric strip 2 fit to the grooves. Portions of the dielectric strips 1 and 2 opposed to each other are stepped so that the distance between the two connection planes is ¼ of the guide wavelength $\lambda g$.

The opposed surfaces of the dielectric plates at the connection between the two dielectric waveguides are formed in such a manner that, as shown in FIG. 32, a portion p of one conductor plate 5*a* projects while the other conductor plate 5*b* opposed to the conductor plate 5*a* is recessed at the corresponding position d, thus forming step portions s.

This structure enables the two dielectric waveguides to be positioned relative to each other along a direction parallel to the flat surfaces of the conductor plates and along a direction perpendicular to the electromagnetic wave propagation direction (the longitudinal direction of the dielectric strips) by abutment of the side surfaces of the above-described step portions when they are opposed to each other with a certain gap formed therebetween, or when they are brought into abutment on each other.

This example differs from that shown in FIG. 32 in that, in the opposed end surfaces of the pairs of conductor plates at the connection between two dielectric waveguides, a portion p of each of the conductor plates 4*a* and 5*a* on one side projects while the conductor plates 4*b* and 5*b* on the other side are recessed at corresponding positions d, thereby forming step portions s.

This structure enables the two dielectric waveguides to be positioned relative to each other along a direction parallel to the flat surfaces of the conductor plates and along a direction perpendicular to the electromagnetic wave propagation direction by abutment of the side surfaces of the above-described step portions when they are opposed to each other with a certain gap formed therebetween, or when they are brought into abutment on each other.

In the examples shown in FIGS. 32 and 33, step portions are formed in only one place as viewed in plan. However, the arrangement may alternatively be such that, for example, as shown in FIG. 34, step portions s are formed in two places so that their side surfaces face in different directions, thereby enabling positioning along each of a direction parallel to the flat surfaces of the conductor plates and a direction perpendicular to the electromagnetic wave propagation direction.

The embodiments have been described with respect to the grooved type dielectric waveguides in which the distance between the flat surfaces of the portions of the conductor plates at the dielectric strip portions is increased relative to the distance between the flat conductor surfaces in the other regions. The present invention, however, can also be applied in the same manner to a normal type dielectric waveguide such as shown in FIG. 31A. In the above-described embodiments, conductor plates each formed of a metal plate or the like are used as flat conductors between which dielectric strip portions are interposed, and dielectric strips are provided separately from the conductor portions having flat surfaces. The present invention, however, can also be applied in the same manner to, for example, a window type dielectric waveguide constructed in such a manner that, as shown in FIG. 31B, dielectric strip portions are integrally formed on dielectric plates 11 and 12, electrodes 13 and 14 are provided on external surfaces of the dielectric plates, and the dielectric strip portions are opposed to each other.

According to the first to fourth aspects of the present invention, electromagnetic waves reflected at the connection planes are superposed to cancel out, thereby reducing the influence of reflection. Therefore, a dielectric waveguide having an improved reflection characteristic can be obtained even if the difference between the linear expansion coefficients of dielectric strips and conductor plates is large, even if the waveguide is used in an environment where there are large variations in temperature, or even if a comparatively large gap is formed between the surfaces of the dielectric strips connected to each other due to a large working tolerance.

According to the fifth and sixth aspects of the present invention, two dielectric waveguides can be positioned along a direction parallel to the conductor plates and along a direction perpendicular to the electromagnetic wave propagation direction. Therefore, a dielectric waveguide can be obtained in which reflection at a connection plane between two dielectric waveguides can be limited and which has an improved transmission line characteristic.

What is claimed is:

1. A dielectric waveguide comprising:

an electromagnetic wave propagation region comprised of a pair of dielectric strips disposed along a direction of propagation of an electromagnetic wave, wherein said pair of dielectric strips are connected to each other at a plurality of planes spaced apart from each other in the direction of propagation of an electromagnetic wave by a first distance corresponding to an odd number multiple of ¼ of the guide wavelength of the electromagnetic wave propagating through the dielectric strips.

2. A dielectric waveguide as claimed in claim 1, wherein one dielectric strip of said pair of dielectric strips comprises a first strip and a second strip, and the other of said pair of dielectric strips comprises a third strip and a fourth strip, said first, second, third and fourth strips being disposed in parallel to each other along said direction of propagation, said first strip and said third strip defining one plane of said plurality of planes, and said second strip and said fourth strip defining another plane of said plurality of planes.

3. A dielectric waveguide device comprising:

a pair of dielectric waveguides each having a dielectric strip placed between first and second conductor plates, wherein said pair of dielectric strips are positioned along a direction parallel to said conductor plates and along an electromagnetic wave propagation direction, wherein said pair of dielectric strips are connected to each other at a plurality of planes spaced apart from each other in the direction of propagation of an electromagnetic wave by a first distance, wherein said first conductor plate of one of said dielectric waveguides is connected to said first conductor plate of the other of said dielectric waveguides at a first conductor connection plane, and wherein said second conductor plate of one of said dielectric waveguides is connected to said second conductor plate of the other of said dielectric waveguides at a second conductor connection plane;

said first and second conductor connection planes being spaced apart from each other in said direction of propagation by a second distance, and wherein one dielectric strip of said pair of dielectric strips comprises a first strip and a second strip, and the other of said pair of dielectric strips comprises a third strip and a fourth strip, said first, second, third and fourth strips being disposed in parallel to each other along said direction of propagation, said first strip and said third strip defining one plane of said plurality of planes, and said second strip and said fourth strip defining another plane of said plurality of planes.

4. A dielectric waveguide device according to claim 3, wherein said first and second distances are equal.

5. A dielectric waveguide comprising:

an electromagnetic wave propagation region comprised of a pair of dielectric strips disposed along a direction of propagation of an electromagnetic wave, wherein said pair of dielectric strips are connected to each other at a plurality of planes spaced apart from each other in the direction of propagation of an electromagnetic wave by a first distance, and wherein one dielectric strip of said pair of dielectric strips comprises a first strip and a second strip, and the other of said pair of dielectric strips comprises a third strip and a fourth strip, said first, second, third and fourth strips being disposed in parallel to each other along said direction of propagation, said first strip and said third strip defining one plane of said plurality of planes, and said second strip and said fourth strip defining another plane of said plurality of planes.

6. A dielectric waveguide device comprising:

a dielectric waveguide comprising:

an electromagnetic wave propagation region comprised of first and second dielectric strips disposed along a direction of propagation of an electromagnetic wave, wherein said first and second dielectric strips are connected to each other at a plurality of planes spaced apart from each other in the direction of propagation of an electromagnetic wave by a first distance corresponding to an odd number multiple of ¼ of the guide wavelength of the electromagnetic wave propagating through the dielectric strips;

a first pair of first and second conductor plates enclosing one of said dielectric strips, and a second pair of first and second conductor plates enclosing the other one of said dielectric strips.

7. A dielectric waveguide device according to claim 6, wherein one of said dielectric strips comprises a first strip and a second strip, and the other of said dielectric strips comprises a third strip and a fourth strip, said first, second, third and fourth strips being disposed in parallel to each other along said direction of propagation, said first strip and said third strip defining one plane of said plurality of planes, and said second strip and said fourth strip defining another plane of said plurality of planes.

8. A dielectric waveguide device according to claim 6, wherein said first conductor plate enclosing one of said dielectric strips is connected to said first conductor plate enclosing the other of said dielectric strips at a first conductor connection plane; and wherein said second conductor plate enclosing one of said dielectric strips is connected to said second conductor plate enclosing the other of said dielectric strips at a second conductor connection plane;

said first and second conductor connection planes being spaced apart from each other in said direction of propagation by a second distance.

9. A dielectric waveguide device according to claim 8, wherein said first and second distances are equal.

10. A dielectric waveguide device according to claim 8, wherein one of said dielectric strips comprises a first strip and a second strip, and the other of said dielectric strips comprises a third strip and a fourth strip, said first, second, third and fourth strips being disposed in parallel to each other along said direction of propagation, said first strip and said third strip defining one plane of said plurality of planes, and said second strip and said fourth strip defining another plane of said plurality of planes.

11. A dielectric waveguide device according to claim 8, further comprising:

a first positioning structure on said first conductor plate enclosing one of said dielectric strips; and a second positioning structure on said second conductor plate enclosing the other one of said dielectric strips;

wherein said first and second positioning structures are engageable so as to relatively position the first and second dielectric strips.

12. A dielectric waveguide device according to claim 11, wherein the first and second positioning structures comprise at least one positioning pin and at least one corresponding positioning hole, respectively.

13. A dielectric waveguide device according to claim 6, further comprising:

a first positioning structure on said first conductor plate enclosing one of said dielectric strips; and a second positioning structure on said second conductor plate enclosing the other one of said dielectric strips;

wherein said first and second positioning structures are engageable so as to relatively position the first and second dielectric strips.

14. A dielectric waveguide device according to claim 13, wherein the first and second positioning structures comprise at least one positioning pin and at least one corresponding positioning hole, respectively.

15. A dielectric waveguide device comprising:

a pair of dielectric waveguides each having a dielectric strip placed between first and second conductor plates;

a first positioning structure on said first conductor plate of one of said dielectric waveguides; and a second positioning structure on said second conductor plate of the other of said dielectric waveguides, wherein said first and second positioning structures are engageable to relatively position the pair of dielectric waveguides, wherein said pair of dielectric strips are positioned along a direction parallel to said conductor plates and along an electromagnetic wave propagation direction, wherein said pair of dielectric strips are connected to each other at a plurality of planes spaced apart from each other in the direction of propagation of an electromagnetic wave by a first distance, wherein said first conductor plate of one of said dielectric waveguides is connected to said first conductor plate of the other of said dielectric waveguides at a first conductor connection plane, and wherein said second conductor plate of one of said dielectric waveguides is connected to said second conductor plate of the other of said dielectric waveguides at a second conductor connection plane;

said first and second conductor connection planes being spaced apart from each other in said direction of propagation by a second distance.

16. A dielectric waveguide device according to claim 15, wherein the first and second positioning structures comprise at least one positioning pin and at least one corresponding positioning hole, respectively.

* * * * *